US010040615B2

(12) United States Patent
Porchia et al.

(10) Patent No.: US 10,040,615 B2
(45) **Date of Patent: *Aug. 7, 2018**

(54) STAND-UP PLASTIC STORAGE BAG HAVING AT LEAST ONE SHIFT REGION AND A CUFF REGION

(71) Applicant: S.C. Johnson & Son, Inc., Racine, WI (US)

(72) Inventors: Jose Porchia, Saginaw, MI (US); Keegan E. Burggren, Mount Pleasant, WI (US); Brian C. Dais, Saginaw, MI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/663,876

(22) Filed: Jul. 31, 2017

(65) Prior Publication Data

US 2017/0327288 A1 Nov. 16, 2017

Related U.S. Application Data

(63) Continuation of application No. 15/442,841, filed on Feb. 27, 2017, now Pat. No. 9,776,781, which is a (Continued)

(51) Int. Cl.
*B65D 33/02* (2006.01)
*B65D 30/18* (2006.01)
(Continued)

(52) U.S. Cl.
CPC ..... *B65D 75/002* (2013.01); *B65D 31/08* (2013.01); *B65D 33/004* (2013.01); *B65D 33/02* (2013.01); *B65D 33/2566* (2013.01)

(58) Field of Classification Search
CPC ..... B65D 75/08; B65D 31/10; B31B 2219/23
(Continued)

(56) References Cited

U.S. PATENT DOCUMENTS 401,687 A * 4/1889 Claussen ..... B65D 31/00 383/121
3,738,565 A 6/1973 Ackley et al.
(Continued)

FOREIGN PATENT DOCUMENTS

FR 2759981 A1 8/1998

OTHER PUBLICATIONS

Notification of and International Search Report and Written Opinion dated Jun. 7, 2016, in corresponding International Patent Application No. PCT/US2015/047937.

*Primary Examiner* — Christopher Demeree

(57) ABSTRACT

A storage bag includes first and second sidewalls having a top edge, a top portion, and a bottom portion. The bottom portion of the first sidewall includes at least one shift region about which the bag is capable of shifting. The shift region includes a score line, an indentation, or a crimp formed into the first sidewall. The top portions of the sidewalls include a cuff region includes a textured patterned band to provide a visual cue to a user as to where to fold and to cuff the bag. The bag shifts between (i) a flat configuration with the sidewalls positioned adjacent to each other, and (ii) a stand-up configuration with the sidewalls separated from each other. In the stand-up configuration, the bag has a substantially flat base. The cuff region can be shifted to a cuffed position with the cuff region forming the opening to the bag.

24 Claims, 20 Drawing Sheets

Related U.S. Application Data continuation of application No. 15/347,816, filed on Nov. 10, 2016, now Pat. No. 9,630,760, which is a continuation of application No. 14/832,215, filed on Aug. 21, 2015, now Pat. No. 9,540,145, which is a continuation-in-part of application No. 14/535,667, filed on Nov. 7, 2014, now Pat. No. 9,499,307, which is a continuation-in-part of application No. 14/204,075, filed on Mar. 11, 2014, now Pat. No. 9,505,525.

(51) Int. Cl.
*B65D 75/00* (2006.01)
*B65D 33/25* (2006.01)
*B65D 33/00* (2006.01)

(58) Field of Classification Search
USPC ..... 383/121, 123, 104, 120; 493/218
See application file for complete search history.

(56) References Cited

U.S. PATENT DOCUMENTS 4,353,497 A 10/1982 Bustin
4,837,849 A 6/1989 Erickson et al.
4,993,844 A 2/1991 Robinson et al.
5,070,584 A 12/1991 Dais et al.
5,178,469 A * 1/1993 Collinson ..... B65D 31/02 383/1
5,375,930 A 12/1994 Tani
5,547,284 A 8/1996 Imer
5,664,299 A 9/1997 Porchia et al.
5,836,056 A 11/1998 Porchia et al.
6,030,652 A 2/2000 Hanus
6,245,367 B1 * 6/2001 Galomb ..... B65D 51/247 206/541
6,334,710 B1 1/2002 Kuge et al.
6,345,911 B1 2/2002 Young et al.
6,409,386 B1 6/2002 Trani et al.
6,533,456 B1 3/2003 Buchman
6,746,388 B2 6/2004 Edwards et al.
6,874,938 B2 4/2005 Price et al.
6,957,915 B2 10/2005 Tankersley
7,052,181 B2 5/2006 Smith et al.
7,452,132 B2 11/2008 Tang
7,784,160 B2 8/2010 Dais et al.
7,886,412 B2 2/2011 Dais et al.
7,946,766 B2 5/2011 Dais et al.
8,061,898 B2 11/2011 Pawloski et al.
8,182,152 B2 5/2012 Plunkett et al.
8,251,881 B2 8/2012 Chertkow et al.
8,251,971 B2 8/2012 Graf et al.
8,267,580 B2 9/2012 Schneider
8,523,440 B2 9/2013 Walker et al.
8,616,768 B2 12/2013 Inagaki et al.
8,847,035 B2 9/2014 Bhatnagar et al.
9,296,171 B2 3/2016 Bierschenk et al.
2002/0168120 A1 11/2002 Wessling et al.
2003/0059130 A1 3/2003 Yoneyama et al.
2004/0161174 A1 8/2004 Bartel et al.
2004/0184682 A1 9/2004 Lovold
2005/0244084 A1 11/2005 Tilman et al.
2006/0120631 A1 6/2006 Tang
2006/0140514 A1 6/2006 Dierl et al.
2007/0127851 A1 6/2007 Tilman et al.
2007/0237433 A1 10/2007 Plunkett et al.
2009/0180718 A1 7/2009 Walker et al.
2009/0232424 A1 9/2009 Bierschenk et al.
2009/0324141 A1 12/2009 Dais et al.
2010/0061665 A1 3/2010 Inagaki et al.
2010/0272377 A1 10/2010 Herbig et al.
2011/0019942 A1 1/2011 Piraneo
2013/0174386 A1 7/2013 Koenigkramer
2013/0177262 A1 7/2013 Anzini et al.
2014/0245698 A1 9/2014 Steele

* cited by examiner

STAND-UP PLASTIC STORAGE BAG HAVING AT LEAST ONE SHIFT REGION AND A CUFF REGION

CROSS REFERENCE TO RELATED APPLICATION

This application is a continuation of copending U.S. patent application Ser. No. 15/442,841, filed Feb. 27, 2017, which is a continuation of U.S. patent application Ser. No. 15/347,816, filed Nov. 10, 2016, now U.S. Pat. No. 9,630,760, issued Apr. 25, 2017, which is a continuation of U.S. patent application Ser. No. 14/832,215, filed Aug. 21, 2015, now U.S. Pat. No. 9,540,145, issued Jan. 10, 2017, which is a continuation-in-part of U.S. patent application Ser. No. 14/535,667, filed Nov. 7, 2014, now U.S. Pat. No. 9,499,307, issued Nov. 22, 2016, which is a continuation-in-part of U.S. patent application Ser. No. 14/204,075, filed Mar. 11, 2014, now U.S. Pat. No. 9,505,525, issued Nov. 29, 2016, which are incorporated herein by reference in their entirety.

BACKGROUND

Field of the Invention

Our invention relates to a storage bag. More specifically, our invention relates to a plastic storage bag that can be shifted between a flat configuration and a stand-up configuration wherein the bag can be easily filled.

Related Art

Storage bags made from flexible plastic materials are well known. Such plastic storage bags are offered in a variety of sizes and can be used to contain a variety of items, including food, utensils, clothing, tools, etc. These storage bags often include a zipper-like closure mechanism to releasably seal the interior of the bag. Different types of plastic storage bags with closure mechanisms are sold by the assignee of the present application under the ZIPLOC® trademark.

It is desirable to configure a plastic storage bag such that a user can set the bag in an opened position with the bag standing upright and without the user having to hold onto the bag. That is, it is desirable for a plastic storage bag to stand upright, with its closure mechanism unsealed, without the user grasping the bag. In such an upright and opened position, the user's hands are free to fill the bag with items. At other times, however, it is desirable for the plastic storage bag to lie as flat as possible. For example, when the bag is not being used, a flat bag may be more compactly stored.

In order to provide a plastic storage bag that can stand upright without the user holding onto the bag, a pleat or gusset is sometimes added to the bottom of the bag. By "pleat" or "gusset" we mean additional material provided between other portions of the bag, for example, a fold formed by doubling back the material forming the bag on itself. An example of such a pleat/gusset arrangement in a bag can be seen in U.S. Pat. No. 3,738,565. In addition to a pleat, a storage bag may be made thicker throughout its sides and bottom to more firmly support itself in an upright position. Both a pleat and a thicker bag, however, require the use of additional material to form the bag, thereby increasing the costs associated with manufacturing the bag. Moreover, a pleat and additional material reduce the ability of the bag to be made flat, for example, when not being used and being stored.

SUMMARY OF THE INVENTION

In one aspect, our invention is directed to a storage bag that includes (A) a first sidewall having a top edge, a top portion, and a bottom portion, and including at least one shift region about which the bag is capable of shifting, the at least one shift region being provided in the bottom portion of the first sidewall, and the at least one shift region comprising one of (a) a score line, (b) an indentation, and (c) a crimp formed into the first sidewall, (B) a second sidewall connected to the first sidewall along three sides of the bag to form an interior of the bag with an opening thereto, the second sidewall having a top edge, a top portion, and a bottom portion, and (C) a cuff region disposed below the top edge of the first sidewall and the top edge of the second sidewall, the cuff region being provided in the top portion of each of the first and second sidewalls, and the cuff region including a textured patterned band to provide a visual cue to a user as to where to fold and to cuff the bag. The bag shifts (a) between (i) a flat configuration with the first and second sidewalls positioned adjacent to each other, and (ii) a stand-up configuration with the first and second sidewalls separated from each other, such that, in the stand-up configuration, the bag has a substantially flat base, and (b) about the cuff region such that the bag can be shifted to a cuffed position with the cuff region forming the opening to the bag.

These and other advantages and features will become more apparent from the following description taken in conjunction with the drawings.

DETAILED DESCRIPTION OF THE INVENTION

Figure 1A:
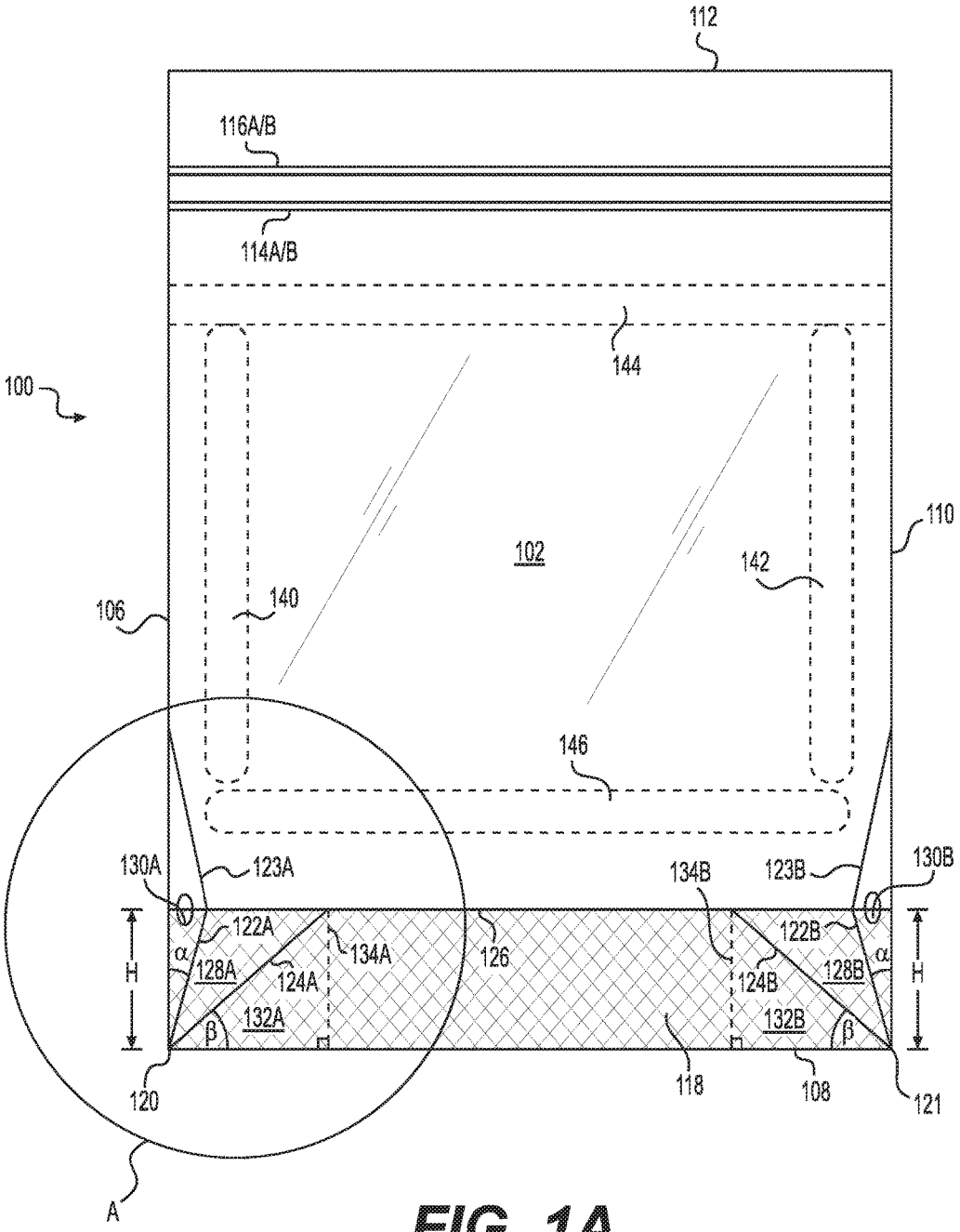
FIG. 1A is a side view of a bag according to our invention in a flat configuration.

Our invention relates to a plastic storage bag that includes features for shifting the bag between a flat configuration and a stand-up configuration. In the stand-up configuration, the bag stands on a substantially flat base without being grasped by a user such that the bag can easily be filled.

As will be apparent from the description herein, the terms "bag" and "storage bag" encompass a broad range of structures designed to contain items. Such bag structures might also be termed pouches, envelopes, packets, and the like. In general, the terms "bag" and "storage bag," as used herein, simply mean a somewhat flexible container with an opening, such that the bag is capable of carrying any number of items. The storage bags may be tailored for particular uses, for example, the bags may be used to store food in a refrigerator in some embodiments, or the bags may be used to store food in a freezer in other embodiments.

FIGS. 1A, 1B, and 2-4 are views of a storage bag 100 according to embodiments of our invention. The bag 100 includes a first sidewall 102 and a second sidewall 104 that are connected along side edges 106 and 110 and along a bottom edge 108. An opening 112 is formed at the top of the bag 100 through which items may be placed into the interior of the bag 100. Notably, the bag 100 does not include a pleat or gusset at the bottom portion 118 between the first and second sidewalls 102 and 104. That is, the first and second sidewalls 102 and 104 are directly connected to each other along the bottom edge 108 of the bag 100 without any sort of folding or expandable structure provided between the sidewalls 102 and 104. The first and second sidewalls 102 and 104 are also directly connected along side edges 106 and 110 without any pleat or gusset connecting the two sidewalls 102 and 104.

The opening 112 may be sealed by the interlocking closure structures 114A, 114B, 116A, and 116B. Interlocking closure structures for plastic storage bags are well known in the art, and examples of different shapes and configurations of interlocking members that can be used with our storage bag 100 can be seen in U.S. Pat. Nos. 5,070,584; 7,784,160; 7,886,412; 7,946,766; and 8,061,898, and in U.S. Patent Application Publication No. 2009/0324141, the disclosures of which are incorporated by reference herein in their entirety. As an alternative to the closure structures 114A, 114B, 116A, and 116B, in other embodiments, a slider-type closure structure could be used to seal the opening 112 of the bag 100 along the top edge of the first and second sidewalls 102 and 104. Examples of slider-type closure structures can be seen in U.S. Pat. Nos. 5,664,299; 5,836,056; and 7,052,181, the disclosures of which are incorporated by reference herein in their entirety.

Illustrative plastic materials that can be used to form the bag 100 include, for example, polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Still other materials that may be used include styrenic block copolymers, polyolefin blends, elastomeric alloys, thermoplastic polyurethanes, thermoplastic copolyesters, thermoplastic polyamides, polymers and copolymers of polyvinyl chloride (PVC), polyvinylidene chloride (PVDC), saran polymers, ethylene/vinyl acetate copolymers, cellulose acetates, polyethylene terephthalate (PET), ionomer, polystyrene, polycarbonates, styrene acryloacrylonitrile, aromatic polyesters, linear polyesters, and thermoplastic polyvinyl alcohols. Those skilled in the art will recognize that a wide variety of other materials may also be used to form the storage bag 100. Those skilled in the art will also recognize that by using the plastic materials described above, the storage bag 100 can be made in a range of colors and transparencies.

A variety of manufacturing techniques may be used to form the plastic storage bag 100. As one specific example, the sidewalls 102 and 104 of the bag 100 can be extruded together as one sheet, with a portion of the first sidewall 102 and a portion of the second sidewall 104 being joined together to form the bag structure using, for example, thermoplastic welding techniques. As another example, the first and second sidewalls 102 and 104 can be formed as separate structures that are joined together along the three edges 106, 108, and 110. Along these lines, when referring herein to the sidewalls 102 and 104 as being "connected" together, the sidewalls may be integrally formed, or, alternatively, the sidewalls 102 and 104 may be separate structures that have been joined together at the connection. The formation of specific additional features of the bag 100 will be described below.

Figure 1B:
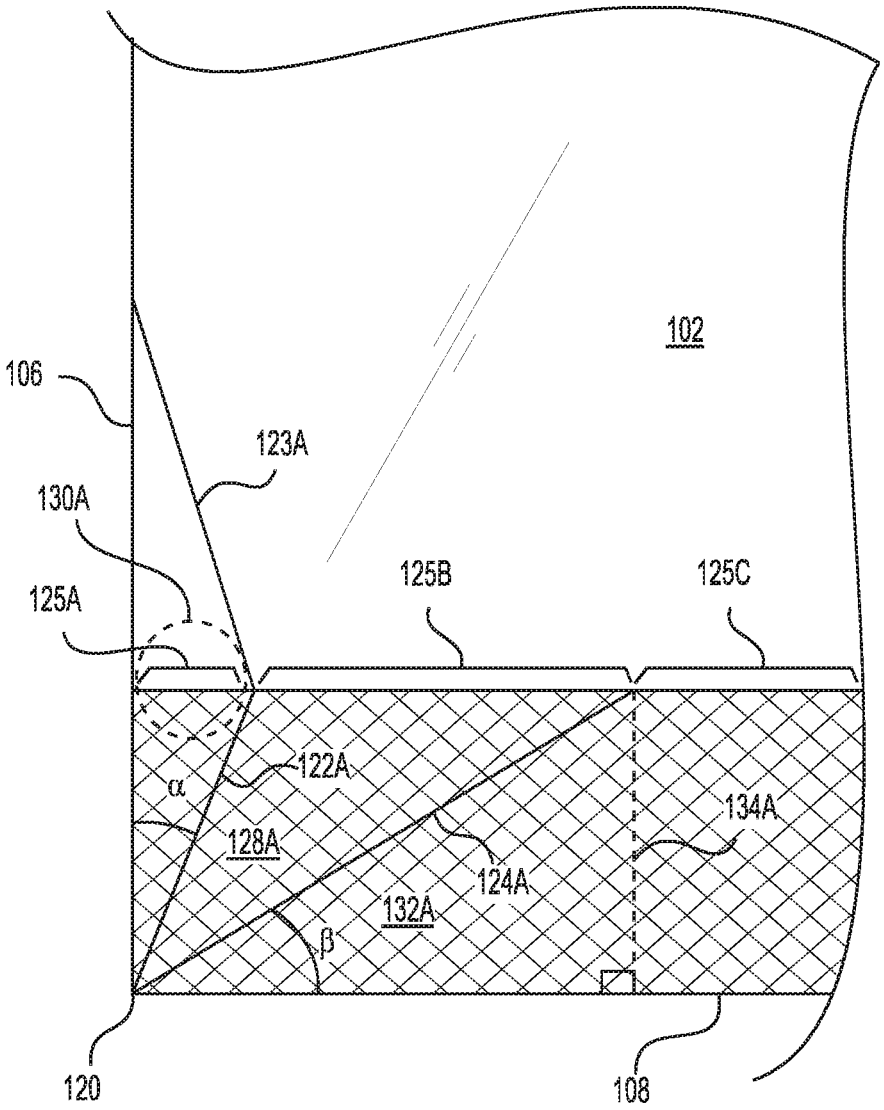
FIG. 1B is a detailed view of the section A of the bag shown in FIG. 1A.
Figure 2:
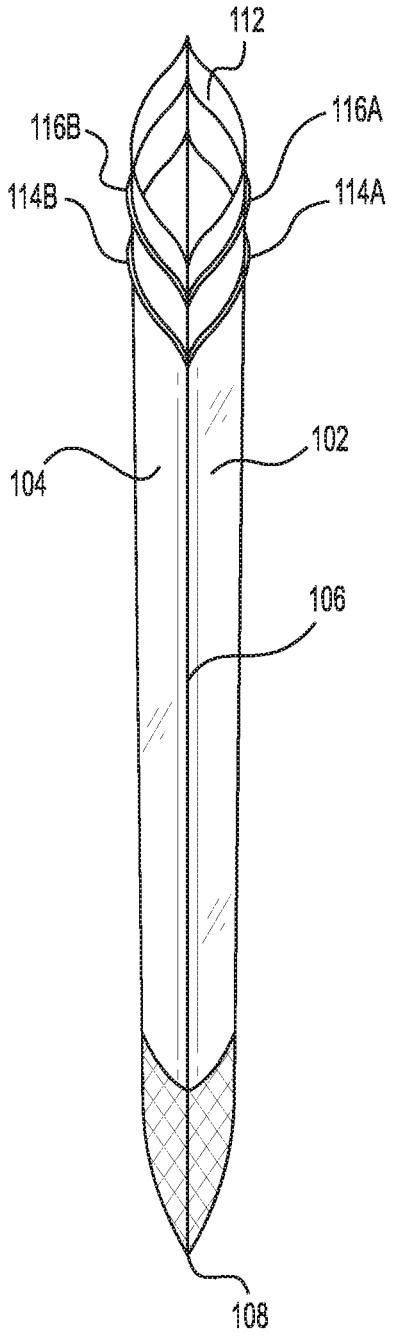
FIG. 2 is an end view of a bag according to our invention in the flat configuration.
Figure 3:
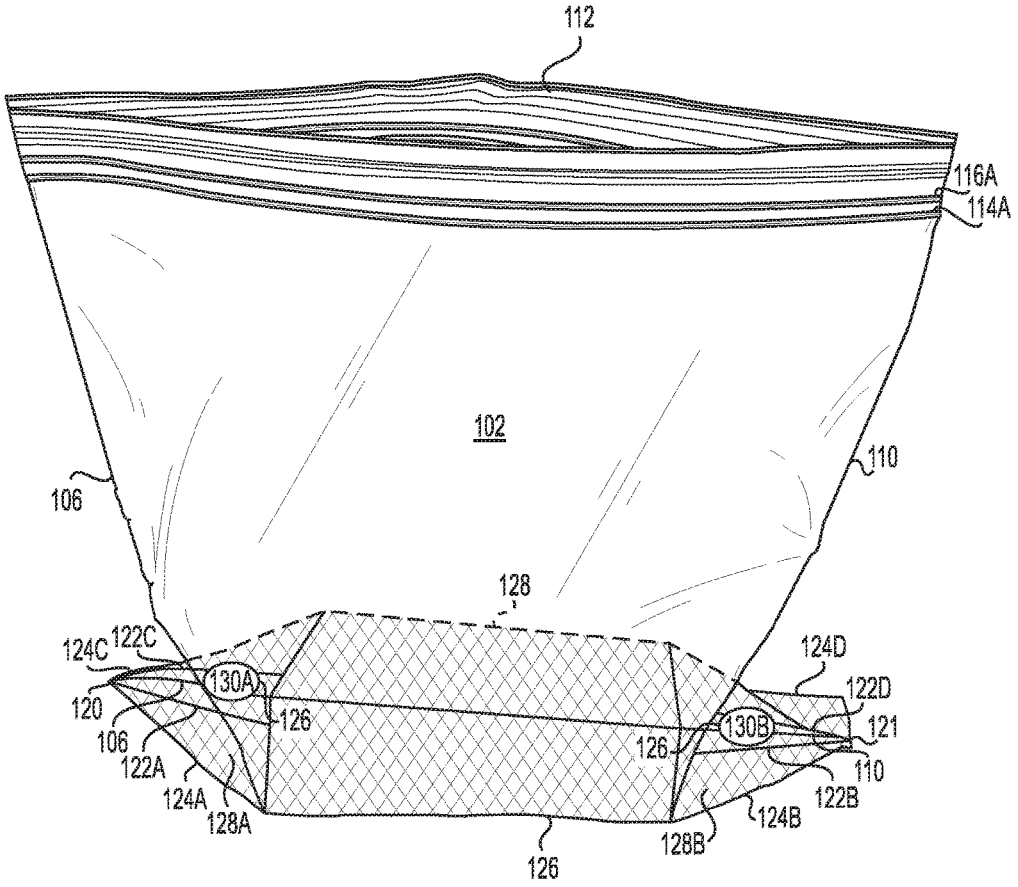
FIG. 3 is a perspective view of the side of a bag according to our invention in a stand-up configuration.
Figure 4:
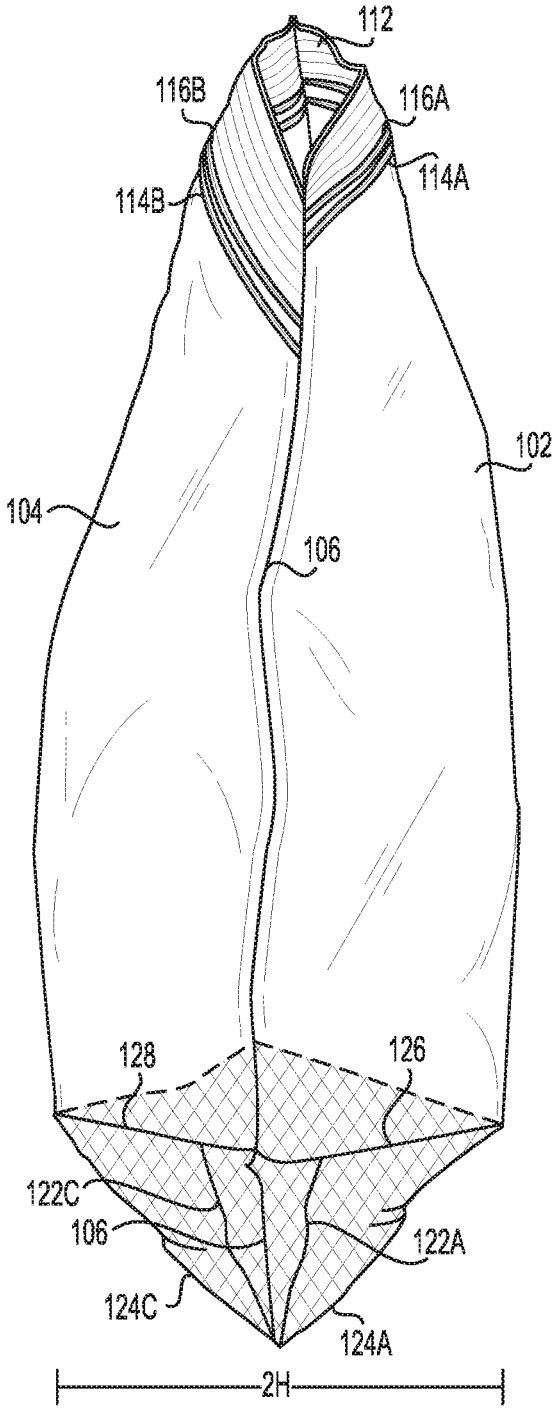
FIG. 4 is a perspective view of the side of a bag according to our invention in the stand-up configuration.

The storage bag 100 according to our invention can be shifted between a flat configuration, as shown in FIGS. 1A, 1B, and 2, and a stand-up configuration, as shown in FIGS. 3 and 4. The bag 100 maintains the stand-up position even though it does not include a pleat or gusset adjacent to its bottom edge 126. Instead, the bag 100 is made to stand upright through unique configurations at the bottom portions 118 of the sidewalls 102 and 104, which will now be described.

As shown in FIGS. 1A and 3, a plurality of shift regions 122A, 122B, 123A, 123B, 124A, 124B, 124C, 124D, 126, and 128 is formed in the bottom portion 118 of the first sidewall 102. FIG. 1B shows the details of the region A in FIG. 1A, including the additional shift regions 125A, 125B, and 125C. The shift regions are configured to allow the bag to be easily shifted between flat and stand-up configurations, as will be described in detail below. In some embodiments, the shift regions 122A, 122B, 123A, 123B, 124A, 124B, 124C, 124D, 125A, 125B, 125C, 126, and 128 are slight indentations, scores, or crimps formed in the sidewalls 102 and 104 of the bag 100 that are made to a depth such that the bag 100 can easily shift about the regions. However, the shift regions 122A, 122B, 123A, 123B, 124A, 124B, 124C, 124D, 125A, 125B, 125C, 126, and 128 are not made to a depth that substantially weakens the integrity of the bag 100. Those skilled in the art will recognize that a variety of techniques can be used to form the shift regions 122A, 122B, 123A, 123B, 124A, 124B, 124C, 124D, 125A, 125B, 125C, 126, and 128, such as cutting the bag 100 with a mechanical structure or, as another example, by using ultrasonic cutting. As yet another example, the shift regions 122A, 122B, 123A, 123B, 124A, 124B, 124C, 124D, 125A, 125B, 125C, 126, and 128 can be formed by deforming the sidewalls 102 and 104 of the storage bag 100 by squeezing portions of the sidewalls 102 and 104 so as to permanently deform the portions in the shapes of the shift regions.

With the shift regions 122A, 122B, 123A, 123B, 124A, 124B, 124C, 124D, 125A, 125B, 125C, 126, and 128, the bag 100 is shiftable between a flat configuration, as shown in FIGS. 1A, 1B, and 2, and a stand-up configuration, as shown in FIGS. 3 and 4. In the flat configuration, the first and second sidewalls 102 and 104 are positioned adjacent to each other. In the stand-up configuration, the first and second sidewalls 102 and 104 are separated from each other. To separate the first and second sidewalls 102 and 104, the bottom portion 118 of the bag is moved about the shift regions 122A, 122B, 123A, 123B, 124A, 124B, 124C, 124D, 125A, 125B, 125C, 126, and 128 such that the bottom portion 118 forms a substantially flat base for the upright bag 100. By being shifted in this manner, the ends of the bottom portion 118 that are adjacent to the corners 120 and 121 extend outward in a triangular-shaped configuration. The bottom portion 118 of the bag 100 is thereby outlined by the shift regions 124A, 124B, 124C, 124D, 126, and 128. When shifting from the flat configuration to the stand-up configuration, the bag 100 is also moved about shift regions 122A and 122B, such that the portions 130A and 130B of the first sidewall 102 are shifted over other portions 128A and 128B of the first sidewall 102. Shifting to the stand-up configuration is facilitated by grasping the bag 100 at the portions 130A and 130B, which, in effect, act as hinges that naturally effect shifting of the bag 100 to the stand-up configuration.

In the embodiment shown in FIGS. 1A to 4, the shift regions are provided on both of the bottom corners of both sidewalls 102 and 104 of the bag 100. Specifically, a plurality of shift regions 124C, 124D, and 128 is provided on the second sidewall 104 corresponding to the shift regions 124A, 124B, and 126 that are provided on the first sidewall 104, as can be seen in FIGS. 3 and 4. Note that by "corresponding," we mean that the shift regions are in the same relative positions on the first and second sidewalls 102 and 104. In other embodiments, however, fewer shift regions may be provided. For example, the shift regions may only be provided in one corner of one of the sidewalls 102 and 104. In still other embodiments, shift regions may be provided on the two bottom corners of one of the sidewalls 102 and 104, but not provided on the other of the sidewalls 102 and 104. In yet other embodiments, the shift regions may be provided on the bottom corner of one of the sidewalls 102 and 104 and other shift regions may be provided on the bottom corner on the other side of the other sidewall 102 or 104, such that the shift regions on one side of the bag 100 do not correspond to shift regions on the other side of the bag 100.

Similarly, the bag 100 may only include some, but not all, of the depicted shift regions 122A, 122B, 123A, 123B, 124A, 124B, 124C, 124D, 125A, 125B, 125C, 126, and 128. For example, in one embodiment, the bag 100 might include the shift regions 122A, 122B, 124A, and 124B, but not include any of the other depicted shift regions 123A, 123B, 124C, 124D, 125A, 125B, 125C, 126, and 128. In such an embodiment, the shift regions 122A, 122B, 124A, and 124B function by themselves to shift the bag 100 from the flat configuration to the stand-up configuration. Also, in the depicted embodiments, the shift regions 122A, 122B, 123A, 123B, 124A, 124B, 124C, 124D, 125A, 125B, 125C, 126, and 128 are shown to extend in continuous lines. In other embodiments, however, the shift regions 122A, 122B, 123A, 123B, 124A, 124B, 124C, 124D, 125A, 125B, 125C, 126, and 128 can be discontinuous. For example, any one of the shift regions can be formed as a plurality of distinct line segments, dots, etc. As will be appreciated by those skilled in the art, the number and continuity of the shift regions provided to a bag according to our invention can be adjusted in order to make the shifting of the bag more or less easy, or the number and continuity of the shift regions can be adjusted based on other factors such as aesthetics and cost of manufacturing of the bag. Along these lines, in some embodiments, the bag may only be provided with one of the shift regions 122A, 122B, 123A, 123B, 124A, 124B, 124C, 124D, 125A, 125B, 125C, 126, and 128.

As can be seen in FIGS. 1A and 1B, there are two angles α and β formed by the shift regions 122A, 122B, 124A, 124B, 124C, 124D, 126, and 128 relative to the side edges 106 and 110, bottom edge 108. Further, with the reference lines 134A and 134B, areas 128A, 128B, 132A, and 132B are defined. Note that reference lines 134A and 134B are provided in FIGS. 1A and 1B for purposes of understanding our invention, but are not actually a structure in the bag 100. As is apparent from the figures, the size of angles α and β determines the relative sizes of the areas 128A, 128B, 132A, and 132B. Generally speaking, we have found that, to facilitate the shifting movement from the flat configuration to the stand-up configuration, the areas 128A and 128B should be approximately equal to the areas 132A and 132B. Further, we have found that shifting is greatly facilitated when the angles α and β satisfy the following Equation (1):

$$\beta = -\frac{4}{7}\alpha + 45 \tag{1}$$

When angles α and β are generally defined by the relation of Equation (1), the bag 100 can be easily shifted from the flat configuration to the stand-up configuration. Note, however, that Equation (1) does not have to be exactly satisfied, but rather, both α and β can vary slightly from the relation while still allowing for the bag 100 to be easily moved from the flat configuration to the stand-up configuration. For example, given a specific angle α, then angle β may vary by less than about ±2 degrees from the value for angle β calculated from Equation (1). Given a specific angle β, then angle α may vary less than about ±4 degrees from the value for angle α calculated from Equation (1). For example, in specific embodiments, angle α is about 14 degrees to about 16 degrees and angle β is about 37 degrees to about 39 degrees. It should again be noted, however, that the bag 100 is not necessarily limited to any particular angle α and angle β.

The horizontal shift regions 126 and 128 extend a height H above the bottom edge 108 of the bag 100. This height H will, in effect, determine the width of the flat base of the bag 100 when the bag 100 is in the stand-up configuration. That is, as shown in FIG. 4, the width of the bottom of the bag 100 is about 2H at a center region of the bag. In embodiments of our invention, the height H is about 1 inch to about 3.5 inches, more specifically, about 1.5 inches to about 3 inches, and still more specifically, about 2 inches to about 2.5 inches. It follows that the width of the base of the bag is about twice these heights, i.e., about 2 inches to about 7 inches, more particularly, about 3 inches to about 6 inches, and still more particularly, about 4 inches to about 5 inches. In a specific embodiment, the height H is about 2 inches, and, thus, the width of the base of the bag is about 4 inches. Generally speaking, with such ranges, storage bags of standard sizes, such as those for storing food, can be made to stand upright.

With the configuration of the bag 100 shown in FIGS. 1A to 4, the bag 100 may be made to stand upright without any additional structural features. For example, unlike other bags known in the art, the bag 100 does not need to include a pleat or gusset between the bottom portions of the first and second sidewalls 102 and 104. In addition, to not require a pleat or gusset, the sidewalls 102 and 104 of the bag 100 can be made with a relatively uniform thickness. Along these lines, in some embodiments, the sidewalls 102 and 104 may have a thickness of only about 1.6 mils to about 2.6 mils. As one of ordinary skill in the art will appreciate, thickness of about 1.6 mils is substantially thinner than the thickness of many types of stand-up plastic storage bags.

While the bag 100 will remain in the stand-up configuration when provided with uniformly thick sidewalls 102 and 104, in other embodiments, specific portions of the bag 100 are made thicker in order to further facilitate the stand-up configuration. In one example, regions of the bottom portions 108 of the sidewalls 102 and 104 of the bag 100 are made thicker than the rest of the bag 100. Specifically, the bottom portions 108 are about twice as thick as the other portions of the sidewalls 102 and 104. In other embodiments, regions of the bottom portions 108 are made about one mil thicker than the other portions of the sidewalls 102 and 104. When an extruding technique is used to manufacture the bag 100, the bottom portions 108 can be made thicker by adjusting the amount of material used to form the bottom portions 108 in comparison with the other portions, e.g., by adjusting the extruding process such that the bottom portions 108 are about 1 mil thicker, while the other portions of the side walls 102 and 104 are reduced by about 0.1 mil of thickness.

In some embodiments, the bottom portions 108 of the first and second sidewalls 102 and 104 can be made visually distinct from the other portions of the first and second sidewalls 102 and 104. For example, a visually distinct texture could be formed in the bottom portions 108 between the horizontal shift regions 126 and 128 of the first and second sidewalls 102 and 104. Such a texture may aid the user in identifying the bottom portions 108 that are to be shifted. Further, the texture may increase the friction of the base when the bag 100 is in the stand-up configuration, thereby further stabilizing the bag 100.

In order to further facilitate the stand-up configuration of the bag 100, other portions of the sidewalls 102 and 104 above the bottom portions 108 can be made stiffer. Examples of such stiffer portions are the areas labeled as 140, 142, 144, and 146 on the first sidewall 102 in FIG. 1A. Although not shown, corresponding stiffer areas can be formed on the second sidewall 104. The stiffer portions 140, 142, 144, and 146 provide structural support to the sidewalls 102 and 104 that helps to maintain the bag upright in the stand-up configuration. While the stiffer areas 140, 142, and 146 extend within the sidewall 102, the stiffer area 144 extends from the edge 106 to the edge 110 of the sidewall 102. By extending the full length of the sidewall 102 and being positioned adjacent to the opening 112 of the bag 100, the stiffer area 144, along with a corresponding stiffer area on the second sidewall 104, helps to maintain the opening 112 in an open position when the bag 100 is in the stand-up configuration and the closure structures 114A, 114B, 116A, and 116B are not sealed. At the same time, the vertical stiffer areas 140 and 142, and the corresponding stiffer areas on the sidewall 104 help to push out the sides of the bag in the stand-up configuration. The bag 100, therefore, can be maintained in an upright position so that it can be easily filled by a user.

The stiffer areas 140, 142, 144, and 146 can be formed by extruding the sidewalls 102 and 104 of the bag in a manner such that the areas 140, 142, 144, and 146 on the first sidewall 102, and the corresponding portions on the second sidewall 104, are made thicker than the other portions of the sidewalls 102 and 104. Alternatively, the stiffer areas 140, 142, 144, and 146 can be formed by applying additional material onto the sidewalls 102 and 104.

In still other embodiments of our invention, upper portions of the bag are made stiffer in order to help maintain the opening 112 in the open position. As will be appreciated by those skilled in the art, the lips are the region of the bag above the closure structures (i.e., the area between the closure structures 116A/B and the top edge of the bag shown in FIG. 1A). In some embodiments, one or both of the lips of the bag are made stiffer, thereby making the opening 112 more readily stay in the open position.

Those skilled in the art will recognize many different ways that the lips of the bag can be made stiffer. For example, additional material can be added to the lip areas in a manner analogous to the way that additional material is added to form the above-described areas 140, 142, 144, and 146. That is, the lips can be made stiffer by providing additional material in the lip areas such that the lips are thicker than other portions of the bag. In this regard, making the lips thicker has an additional benefit of making the lips easier to grasp, for example, when the bag is being opened. In a specific example, the lips are made 20% stiffer than other portions of the bag, thereby making the bag opening more readily stay in the open position and making the lips easier to grasp.

Additional material provided to make the lips stiffer can be the same material as the material that is used to form the rest of the bag. Alternatively, a different material can be used to stiffen the lips. For example, the bag can be made from PE, and HDPE can be added to the lip areas in order to make the lips stiffer. In other embodiments, the lips themselves can be at least partially formed from a different, stiffer material than other portions of the bag. For example, when the bag is primarily formed from PE, the lips can be separately formed from HDPE, with the higher density HDPE making the lips stiffer than the rest of the bag. Of course, the material used to form the lips added to the lip areas, or the additional material added to the lips, can be any material that is compatible with the other materials used to form the bag.

As indicated above, the closure structure or closure structures of a bag are positioned near the opening. Thus, in addition to, or as an alternative to, making the lips stiffer, the closure structure or structures of the bag can be formed from a material that is stiffer than other portions of the bag, thereby making the bag more readily stay in the open position (when the closure structures are not functioning to close the opening). In an embodiment that includes stiffer closure structures, the closure structures are made from HDPE, whereas the rest of the bag is made from PE.

Figure 5:
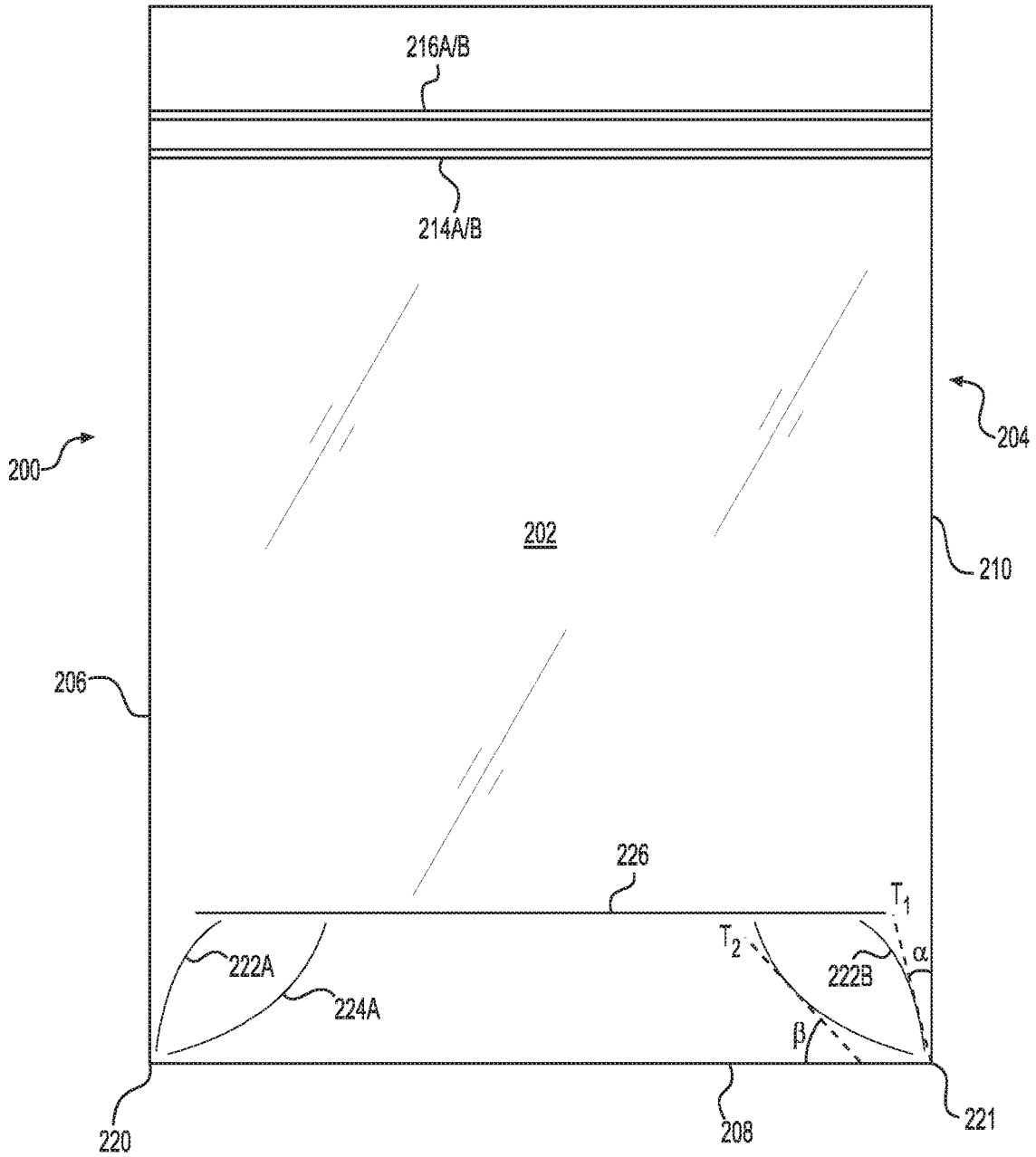
FIG. 5 is a side view of a bag according to another embodiment of our invention.

FIG. 5 is a side view of a bag 200 according to another embodiment of our invention. The bag 200 includes some of the features that are provided in the embodiments described above, including sidewalls 202 and 204 and closure structures 224A, 224B, 226A, and 226B. In the bag 200, however, the shift regions 222A, 222B, 224A, and 224B do not extend all the way to corners 220 and 221. Instead, the shift regions 222A, 222B, 224A, and 224B extend from positions close to, but not directly adjacent to, the corners 220 and 221. In this regard, the shift regions in embodiments of our invention may extend from positions "near" the corners, in that the shift regions extend from positions directly adjacent to the corners, as shown in the bag 100 in FIG. 1A, or from other positions "near" the corners, in that the shift regions extend from positions that are close to the corners, as shown in FIG. 5 with respect to bag 200.

The shift regions 222A, 222B, 224A, and 224B of bag 500 are not straight, but instead, have a curved shape. The bag 200 is shiftable between a flat configuration and a stand-up configuration by being shifted about the curved shift regions 222A, 222B, 224A, 224B, and 226 in a manner similar to the way that the bag 100 shifts between configurations, as described above. With the curved shift regions 222B and 224B, the angle α is measured between the side 210 and a line T1 that is tangent to a point in the middle portion of the shift region 222B, and the angle β is measured between the bottom 208 and a line T2 that is tangent to a point in the middle portion of the shift region 224B. Although not shown, similar angles α and β can be measured between lines tangent to the shift regions 222A, 224A, the side edge 206, and the bottom edge 208. The angles α and β may be in the relation of Equation (1), as described above.

In the embodiments described above, a bag according to our invention is described as being provided with shift regions that are formed as indentations in the bags. In other embodiments, however, the locations about which the bag is shifted between the flat and stand-up configurations could be formed in a different manner, such as by providing additional polymeric material to the sides of the bag. For example, polyethylene may be provided on the sides of the bag at the same positions as the above-described shift regions on the bag. Those skilled in the art will appreciate the variety of techniques that could be used to apply such additional material, for example, nozzles that turn on and off to rapidly deposit the material in the pattern of the shift regions. In other embodiments, the locations about which the bag can be shifted are provided as regions of varying thickness, elevation, etc., in the sides of the bag. In this regard, FIGS. 6A-6G are cross-sectional views of portions of bags according to embodiments of our invention, with the cross sections including different shift regions 600A to 600G. Any of the shift regions 600A to 600G may be provided at locations about which the bag can be shifted between the flat and stand-up configurations, such as the positions of the shift regions in the embodiments described above. Thus, the shift regions 600A to 600G provide for a bottom when the bag is in a stand-up configuration, and the bag need not include a pleat or gusset formed between the sidewalls at the bottom of the bag.

Figure 6A:
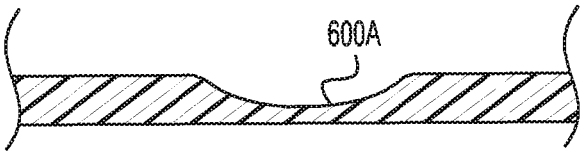
FIGS. 6A-6G are cross-sectional views of portions of bags according to embodiments of our invention.
Figure 6B:
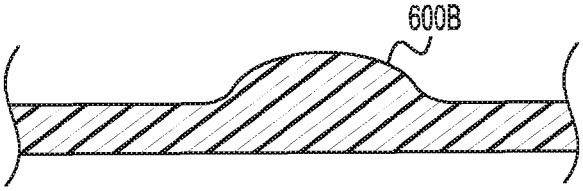
Figure 6C:
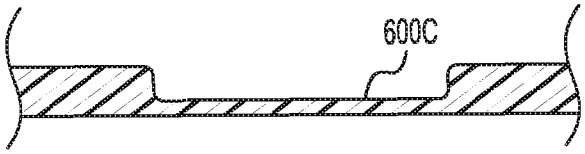
Figure 6D:
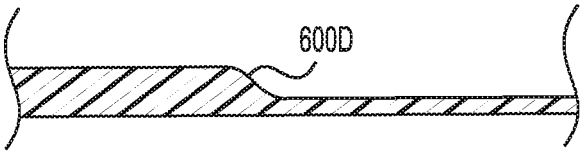
Figure 6E:
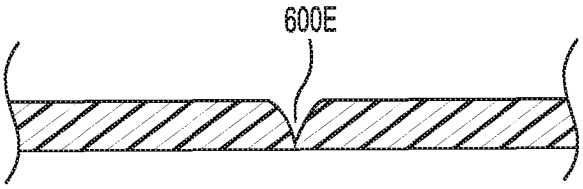
Figure 6F:
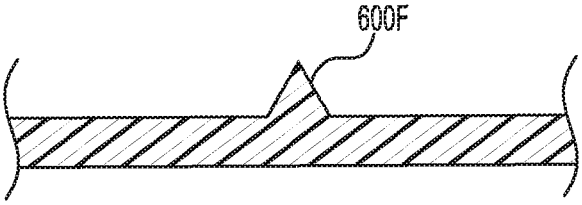
Figure 6G:
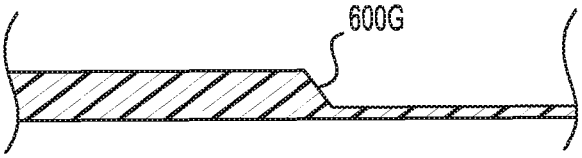
Figure 7:
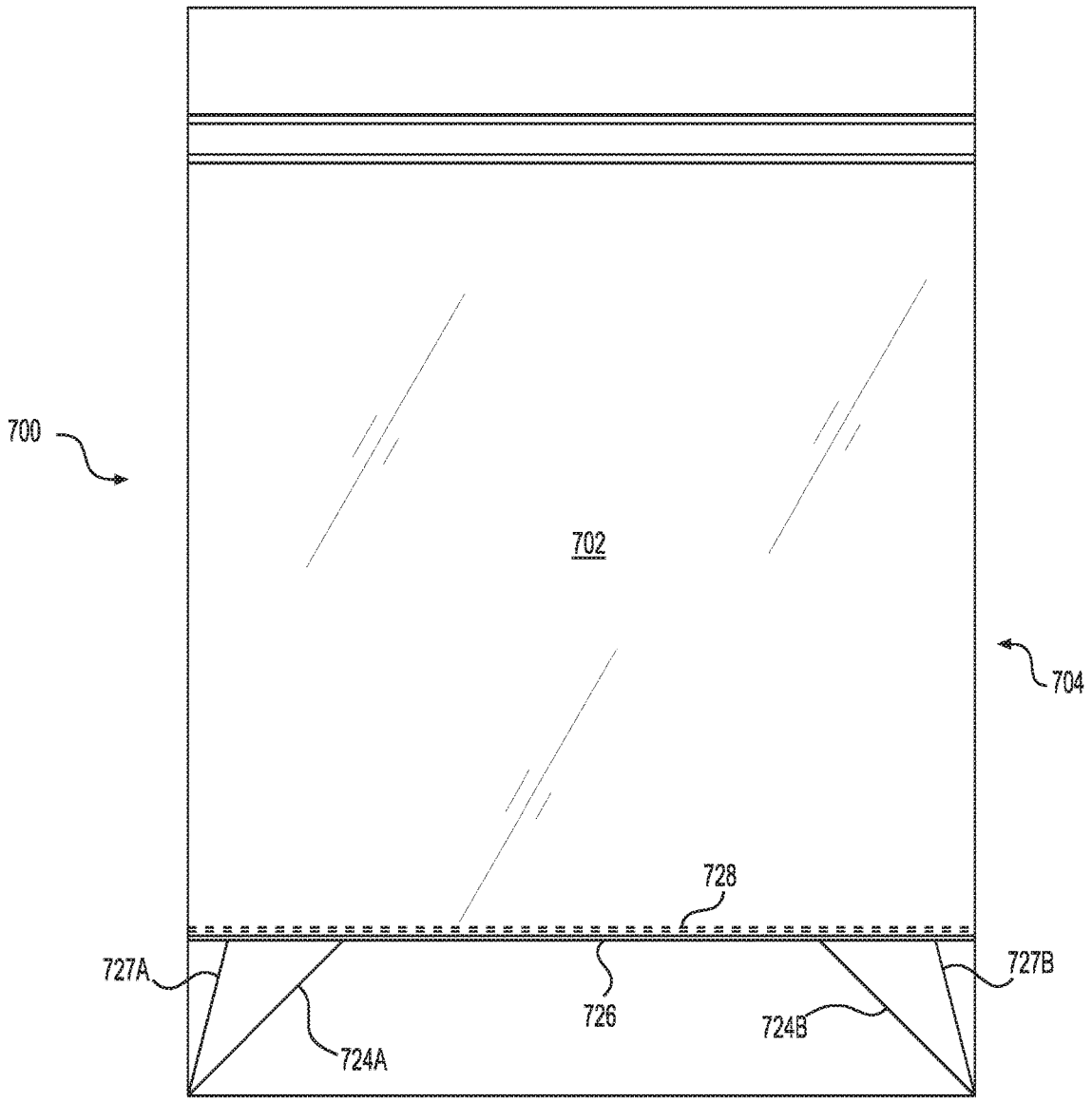
FIG. 7 is a side view of a bag according to yet another embodiment of our invention.

FIG. 7 shows a specific example of how a shift region, as generally depicted in FIG. 6B, can be used in a bag according to our invention. The bag 700 includes shift regions 727A, 727B, 724A, 724B, 726, and 728 (the region 728 being provided on the sidewall 704 that is opposite from the shown sidewall 702). In this embodiment, the shift regions 726 and 728 have a bead-like configuration. Note that the beaded shift regions 726 and 728 correspond in their positions to the shift regions 126 and 128 of the bag 100 shown above. As such, the shift regions form the edges of the base of the bag 700 when the bag is shifted to the stand-up configuration.

The beaded shaped shift regions 726 and 728 can be formed from the same material as that of the bag, for example, by specifically extruding the material that forms the sidewalls 702 and 704 such that the shift regions 726 and 728 are formed with the beaded shape. Alternatively, the beaded shift regions 726 and 728 can be formed by using a different material to form the sidewalls of the bag, with the different material being used to form the shift regions 726 and 728 at the same time as the sidewalls 702 and 704 are formed, or by adding the different material to form the shift regions 726 and 728 after the sidewalls 702 and 704 are formed. In this regard, the shift regions 726 and 728 can be formed from any of the plastic materials we discussed above. As other examples, the material used to form the beaded shift regions 726 and 728 could be an adhesive, an ink, or a wax material. In some cases, the additional material used to form the beaded shift regions 726 and 728 is not directly attached to the sidewalls 702 and 704 of the bag, but rather one or more intermediate layers are formed between the beaded shift regions 726 and 728 and the sidewalls 702 and 704. In still other embodiments, the beaded regions 726 and 728 themselves are formed from multiple layers of one or more materials.

The beaded shift regions 726 and 728 can be formed to any thickness such that the regions facilitate shifting of the bag, as described above. In some embodiments, however, the beaded shift regions 726 and 728 are about two to about twenty times thicker than the sidewalls 702 and 704 of the bag. In still more specific embodiments, the beaded shift regions 726 and 728 are about 2 to about ten times thicker than the sidewalls 702 and 704 of the bag. And, in a specific embodiment, the beaded shift regions 726 and 728 extend about 15 mils from the surface of the sidewalls 702 and 704.

It should be noted that while the beaded shift regions 726 and 728 are depicted on the outside surfaces of the sidewalls 702 and 704, as is the case with all of the shift regions described herein, one or both of the beaded shift regions 726 and 728 could be provided on the inside surfaces of the sidewalls 702 and 704 (i.e., in the interior of the bag). It should also be noted that while the beaded shift regions 726 and 728 have a generally rounded shape as shown in FIG. 6B, the beaded shift regions 726 and 728 may be more or less rounded than depicted. In fact, the beaded shift regions 726 and 728 need not be rounded, but rather may be formed in any shape, e.g., square, rectangular, or triangular.

In the embodiment depicted in FIG. 7, the beaded shift region 726 on sidewall 702 is slightly offset from the corresponding beaded shift region 728 on sidewall 704 such that the beaded shift regions 726 and 728 are not positioned immediately adjacent to each other when the bag 700 is in the flat configuration. This offset is not required, but the offset may minimize the formation of leaks wherein the shift regions 726 and 728 meet the sides 106 and 110 of the bag. Of course, as generally described above, in some embodiments, the beaded shift regions 726 and 728 do not extend to the sides 106 and 110, but rather only extend over a part of the length of the sidewalls 702 and 704 of the bag. Further, as also generally described above, the beaded shift regions 726 and 728 may be continuous or discontinuous.

Figure 8:
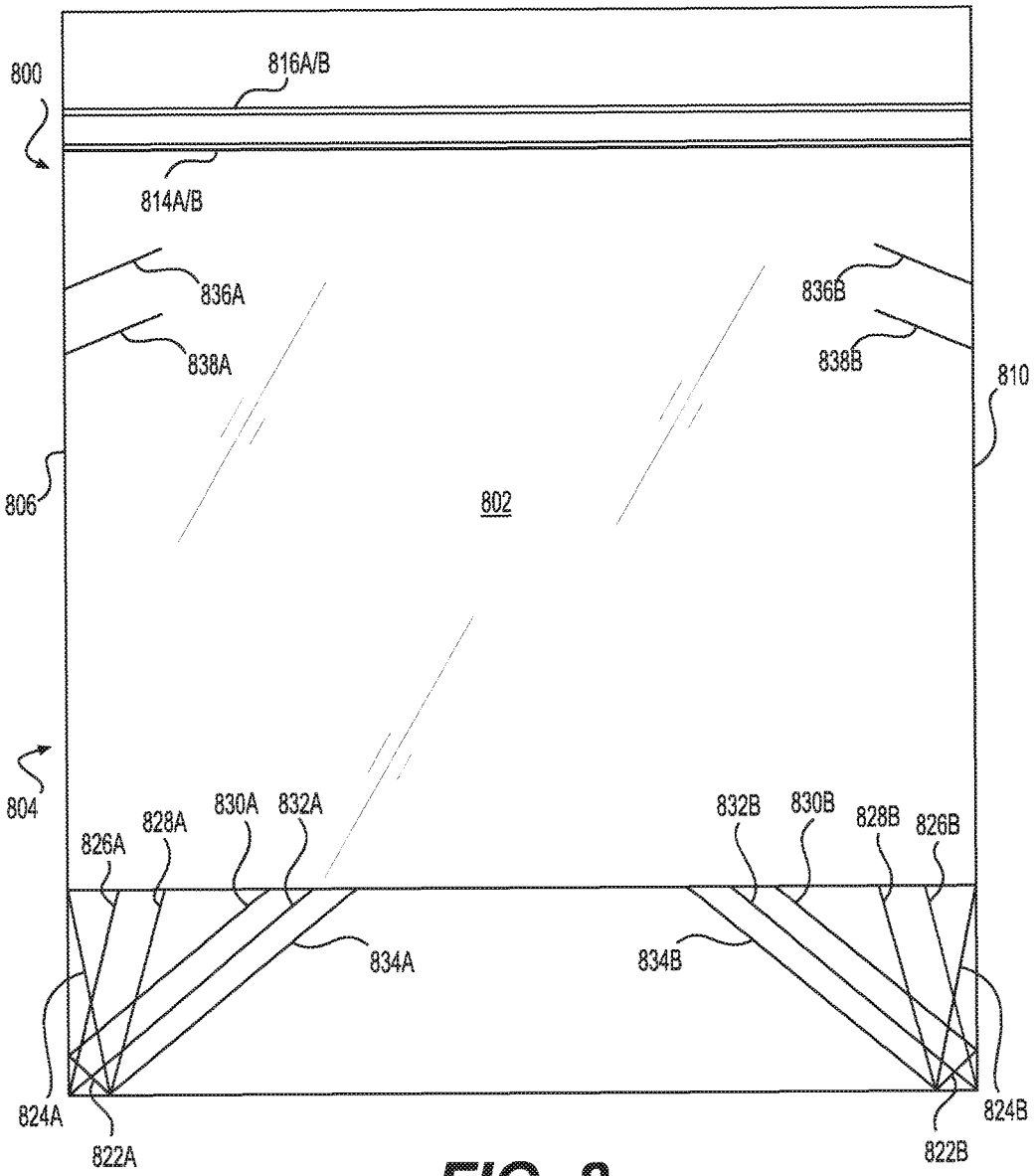
FIG. 8 is a side view of a bag according to a still further embodiment of our invention.

A still further embodiment of the invention is shown in FIG. 8. This embodiment includes additional shift regions in the lower and upper portions of the sidewalls 802 and 804 of the bag 800. With respect to the bottom portion, a pattern of seven shift regions 822A, 824A, 826A, 828A, 830A, 832A, and 834A is provided near one of the bottom corners of sidewall 802, and a similar pattern of seven shift regions 822B, 824B, 826B, 828B, 830B, 832B, and 834B is provided at the other corner of sidewall 802. These shift regions 822A, 824A, 826A, 828A, 830A, 832A, 834A, 822B, 824B, 826B, 828B, 830B, 832B, and 834B can take any of the forms described above, e.g., indentations, scores, beads, etc. Notably, the pattern of these shift regions is such that some of the shift regions cross one or more of the other shift regions. For example, shift region 828A crosses shift region 830A and shift region 832A. As another example, shift region 824A crosses shift regions 826A, 828A, and 830A. We have found that such a pattern, with at least one shift region crossing another shift region, facilitates the shifting function, thereby making it easier to move the bag between the flat and stand-up configurations. And, having multiple shift regions cross more than one shift region still further enhances the shifting functionality. Note that, although not shown in FIG. 8, a similar pattern of shift regions can be formed at the bottom two corners of the opposite sidewall 804 of the bag 800. Further, any combination of such shift regions can be formed at the corners of the bag, e.g., the shift regions are only provided at one corner on sidewall 802 and one corner of the sidewall 804. Also, the pattern shown may be altered such that one or more of the shift regions is omitted, or one or more additional shift regions are provided.

With respect to the upper portion of bag 800, shift regions 836A and 838A are provided on sidewall 802 below the closure structures 814A/B and 816A/B, with the shift regions 836A and 836B extending from the side 806 of the bag 800. Similarly, shift regions 836B and 838B are provided extending from the side 810. The additional shift regions 836A, 836B, 838A, and 838B help to maintain the opening 812 of the bag in the open position by causing portions of the bag 800 to deflect along the shift regions 836A, 836B, 838A, and 838B when the bag 800 is opened. These shift regions 836A, 836B, 838A, and 838B can take any of the shift region forms described above, e.g., indentations, scores, beads, etc. And, the shift regions 836A, 836B, 838A, and 838B can be provided anywhere in the general area of the upper portion near sides 806 and 808. In a specific embodiment, however, the shift regions 836A and 836B are about one inch below the closure structures 814A/B, as measured along sides 806 and 810, and the shift regions 838A and 838B are about one-half inch below the shift regions 836A and 836B (about one and one-half inches below the closure structures 814A/B), as measured along sides 806 and 810. In the specific embodiment, the shift regions 836A, 836B, 838A, and 838B extend about one inch along sidewall 802, as measured in a line perpendicular from sides 806 and 810.

In some embodiments, shift regions corresponding to shift regions 836A, 836B, 838A, and 838B are provided on the second sidewall 804 of the bag 800. Those skilled in the art will recognize that more or less shift regions can be provided in a similar manner to the 836A, 836B, 838A, and 838B on either of the upper portions of the sidewalls 802 and 804.

Any of the shift regions provided on the bag 800 can be combined with any of the other embodiments of our bag as described herein. For example, the shift regions 836A, 836B, 838A, and 838B could be provided on the bags 100 and 200 described above. Further, features from the other embodiments described herein can also be provided with bag 800. For example, the visually distinct texture described above can be provided on the bottom portion of bag 800, if desired. More generally, as will be fully appreciated by those skilled in the art, any of the features described herein with respect to a specific embodiment may be combined with, or substituted for, features of another specific embodiment. For example, a bag according to our invention could be formed with the combination of (1) the stiffer portions 140, 142, 144, and 146, as described in conjunction with the bag 100, (2) the curved shift regions 222A, 222B, 224A, and 224B, as described in conjunction with the bag 200, (3) the beaded shift region, as described in conjunction with the bag 700, and (4) the shift regions 836A, 836B, 838A, and 838B, as described in conjunction with the bag 800.

Figure 9A:
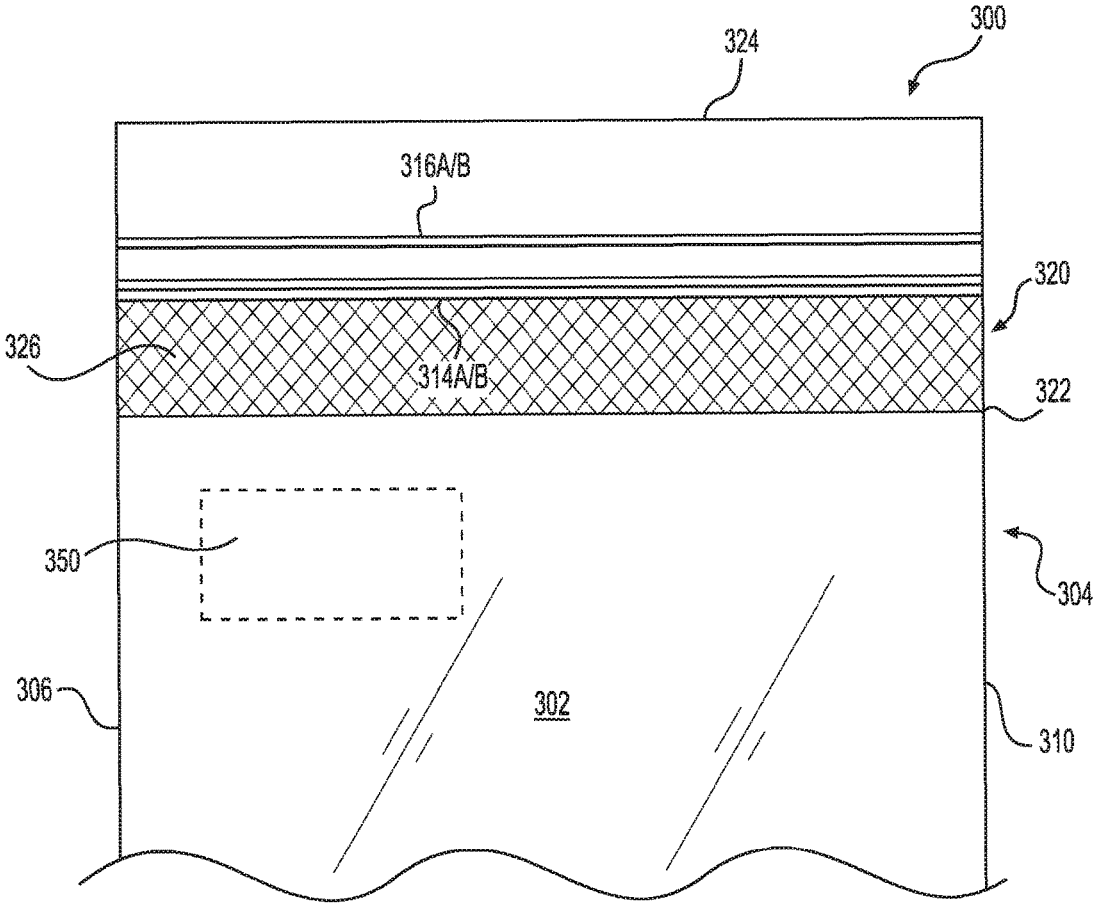
FIG. 9A is a partial side view of a bag according to another embodiment of our invention.

FIG. 9A is a partial side view of a bag 300 according to another embodiment of our invention. The bag 300 includes some of the features that are provided in the embodiments described above, including sidewalls 302 and 304 that are connected along side edges 306 and 310, and interlocking closure structures 314A, 314B, 316A, and 316B. Although not shown in FIG. 9A, the bottom of the bag 300 of this embodiment includes a plurality of shift regions (not shown) that allow for the bag 300 to be shifted between a flat configuration and a stand-up configuration, according to the various embodiments described above. The bag 300 maintains the stand-up position even though it does not include a pleat or gusset adjacent to its bottom edge. Instead, the bag 300 is made to stand upright through the unique configurations described above and shown in, for example, FIGS. 1A-8.

Figure 9B:
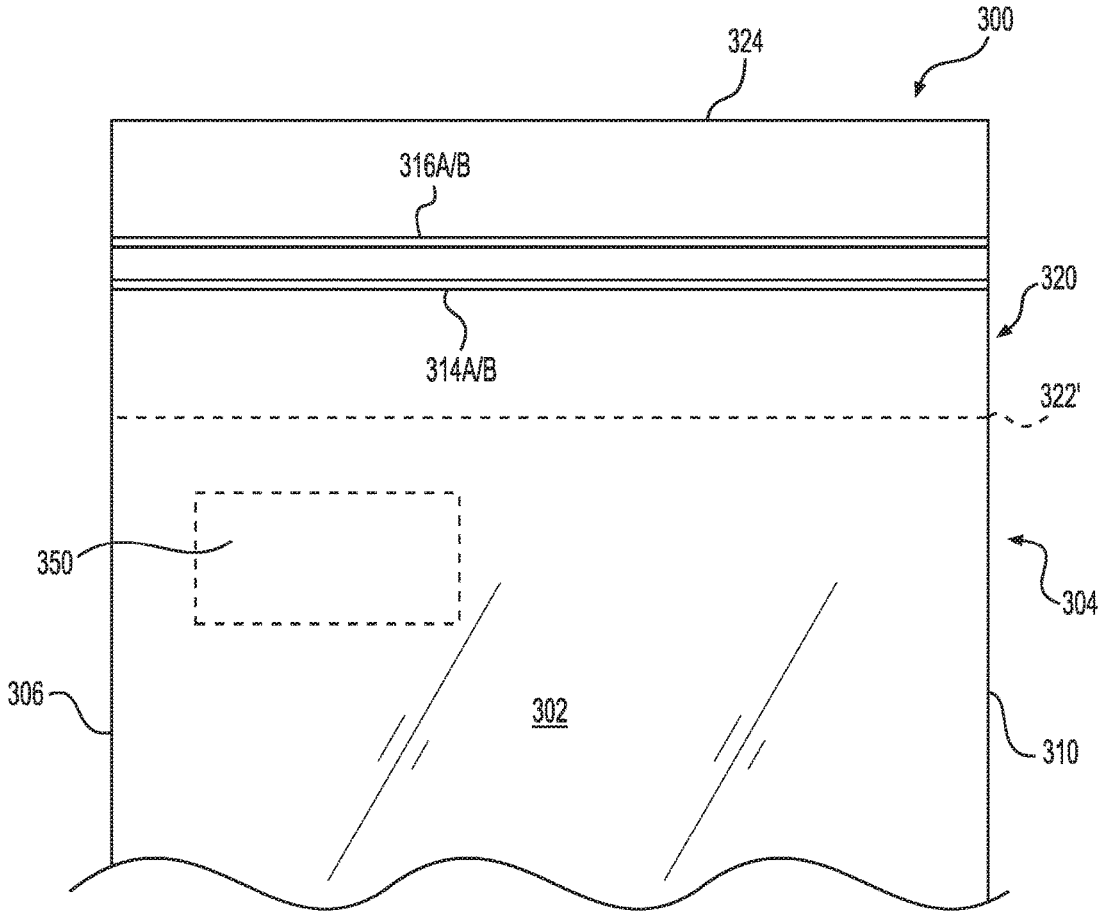
FIG. 9B is a partial side view of a bag according to another embodiment of our invention.
Figure 9C:
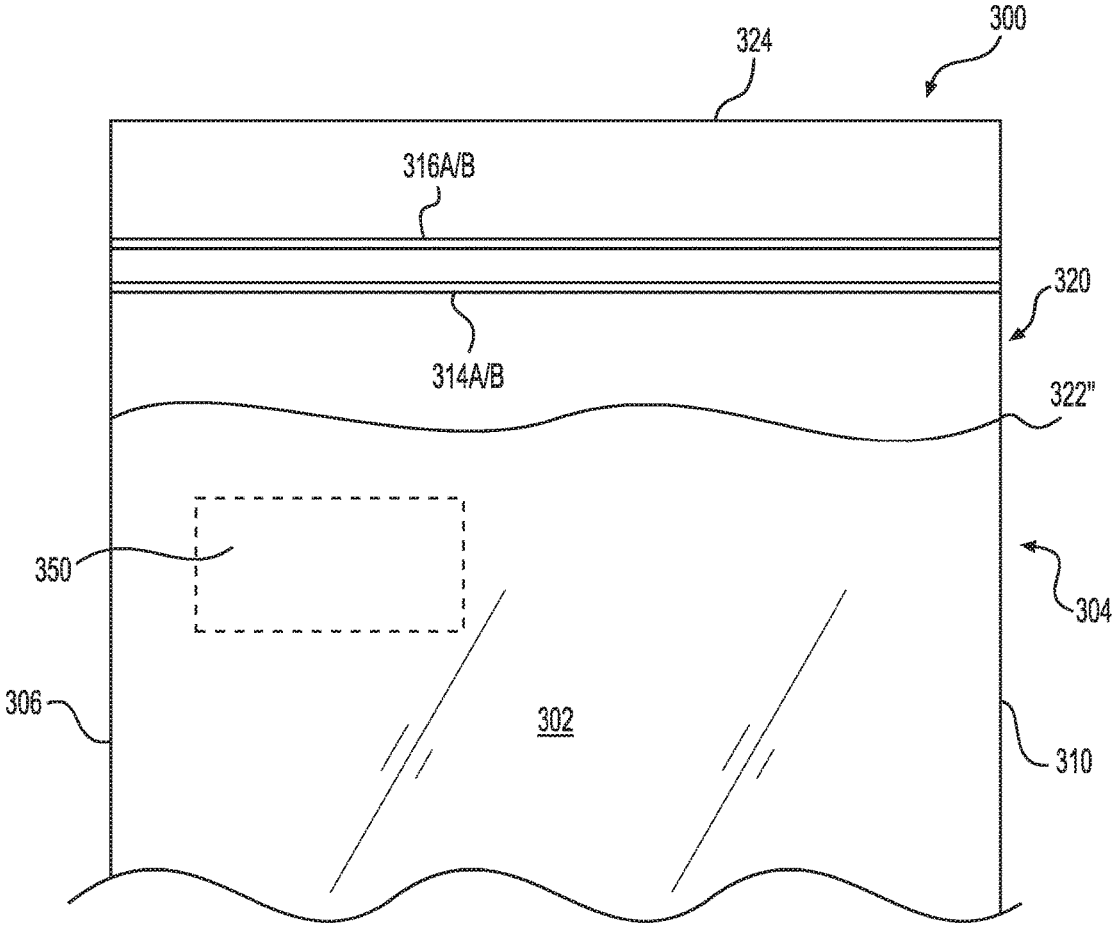
FIG. 9C is a partial side view of a bag according to another embodiment of our invention.
Figure 9D:
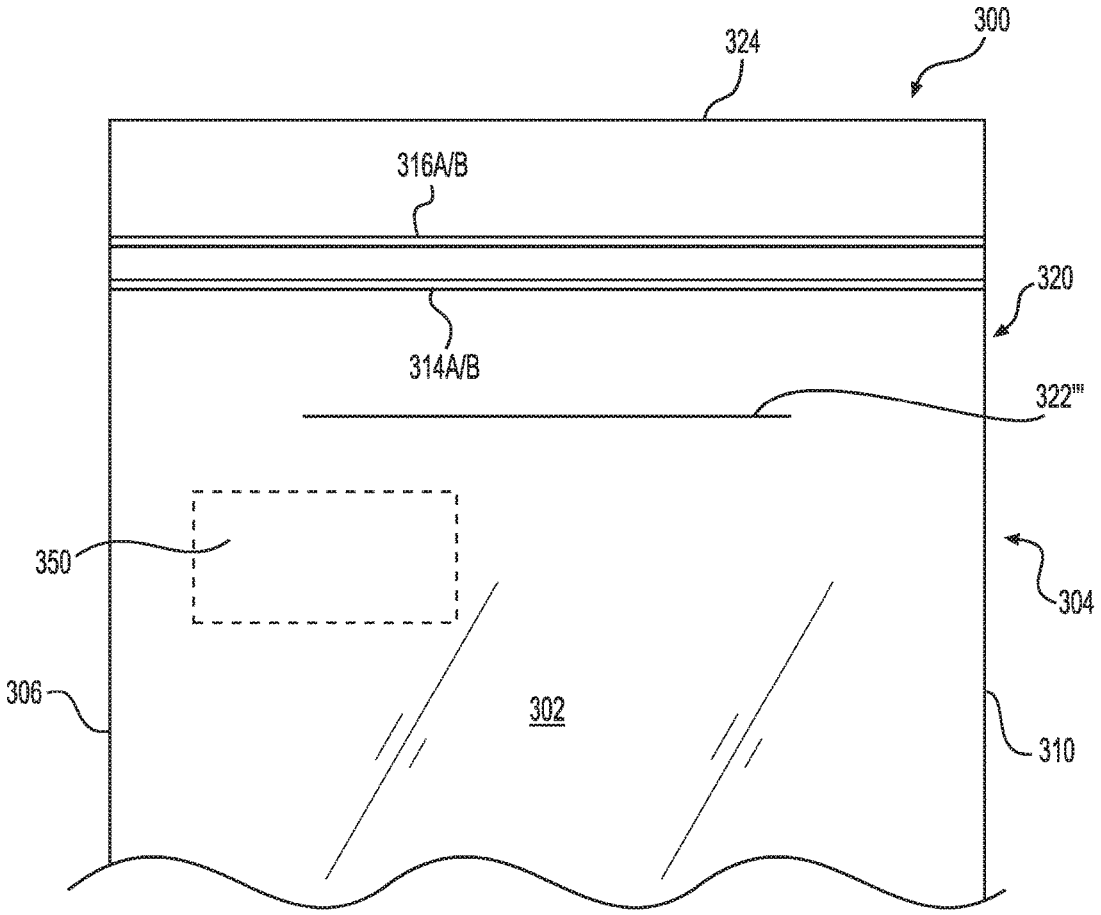
FIG. 9D is a partial side view of a bag according to another embodiment of our invention.
Figure 9E:
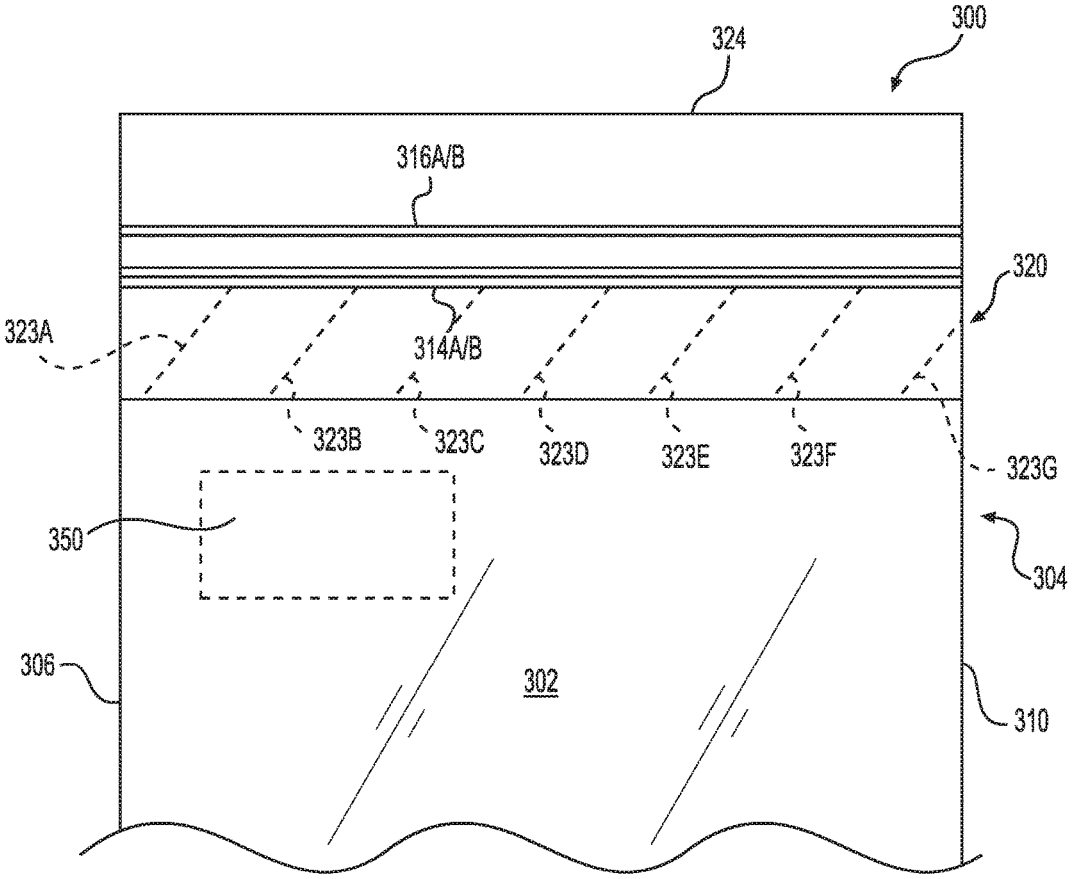
FIG. 9E is a partial side view of a bag according to another embodiment of our invention.

The bag of the embodiment of FIG. 9A further includes a cuff region 320 that extends from a cuff line 322 to a point at or below a top edge 324 of the bag 300, including, for example, to a point at or below the interlocking closure structures 314A, 314B, 316A, and 316B. The cuff line 322 of the cuff region 320 comprises a slight indentation, score line, or crimp formed in the sidewalls 302 and 304 of the bag 300, such as those used to form the shift regions of the embodiments described above, and made to a depth such that the bag 300 can be easily folded about the cuff line 322. However, the cuff line 322 is not made to a depth that substantially weakens the integrity of the bag 300. Those skilled in the art will recognize that a variety of techniques can be used to form the cuff line 322, such as cutting the bag 300 with a mechanical structure or, as another example, by using ultrasonic cutting. Alternatively, the cuff line 322 can comprise a dashed line (see, e.g., 322' of FIG. 9B), a curved line (see, e.g., 322" of FIG. 9C), or a partial line that does not extend across the length of the bag 300 (see, e.g., 322''' of FIG. 9D). The cuff region 320 can further comprise a plurality of shift or inflection regions (see, e.g., 323A-323G of FIG. 9E), such as those described in the embodiments above, in order to assist in initiating the cuffing action by the user.

The cuff region 320, the cuff line 322, 322', 322", 322', and/or the shift regions 323A-323G allow for a user to easily cuff or fold the bag 300 about the cuff region 320, the cuff line 322, 322', 322", 322', and/or the shift regions 323A-323G, which provides a bag with a wide open mouth that is easier to fill, particularly when the bag 300 is in a stand-up configuration (see, e.g., FIGS. 10A and 10B), and further prevents zipper contamination when filling the bag and the ability to easily pour contents out of the bag. The cuff line 322, 322', 322", 322''' can be positioned anywhere along the bag where a user may prefer cuffing or folding the bag 300. In one embodiment, the cuff line 322, 322', 322", 322''' is positioned from about ⅛ in. to about 2 in. below the lower closure structures 314A and 314B. In one preferred embodiment, the cuff line 322, 322', 322", 322''' is positioned about ⅝ in. below the lower closure structures 314A and 314B.

As also shown in FIG. 9A, the cuff region 320 comprises a patterned band 326 that is provided between the interlocking closure structures 314A, 314B, 316A, and 316B and the cuff line 322. The patterned band 326 can comprise a printed pattern formed by a variety of printing techniques. The patterned band 326 can also, or alternatively, comprise a texture that can be formed by a variety of techniques, including, for example, embossing, extrusion, ultrasonic forming and blasting with sand or water jets, scratching the surface with a laser or other means, etc. The patterned band 326 can disguise the cuff line 322, as well as any shift or inflection regions that assist in initiating the cuffing action by the user. The patterned band 326 can also add some stiffness to the cuff region 320, which assists in maintaining the wide open mouth of the bag 300 when the bag 300 has been cuffed (see, e.g., FIG. 10B). The patterned band 326 can further provide a visual cue to a user as to where to fold down the cuff region 320 and cuff the bag 300 along the cuff line 322. The patterned band 326 can be of any width and can further extend to a position above, below, or over the cuff line 322. In one preferred embodiment, the patterned band extends from the lower closure structures 314A and 314B (or from a point just below the lower closure structures 314A and 314B) to the cuff line 322. The bag 300 of FIG. 9A further includes a graphic region 350 in which a visual cue, such as a message or image, can be displayed to a user that indicates that the bag 300 can be cuffed along the cuff region 320 and/or cuff line 322. The graphic region 350 can be formed by a variety of printing techniques.

Figure 10A:
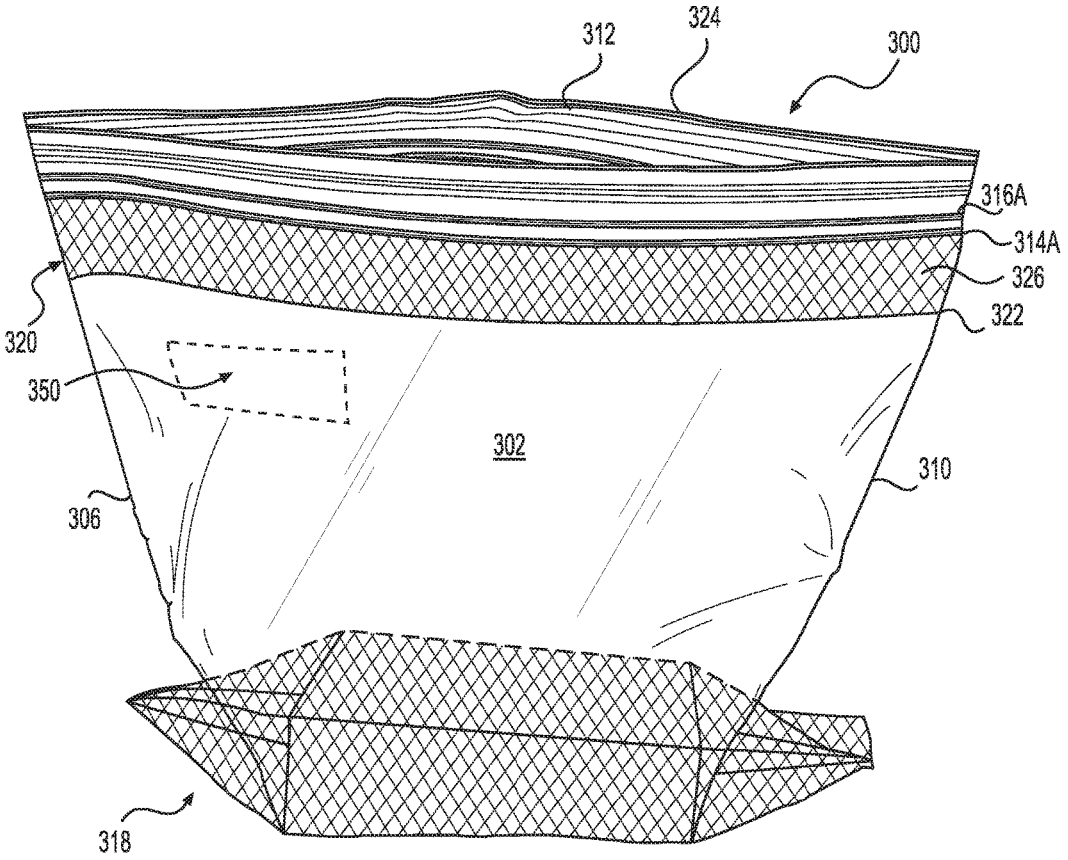
FIG. 10A is a perspective view of a bag according to the embodiment of FIG. 9A in a stand-up configuration.

FIG. 10A illustrates the bag 300 of the embodiment of FIG. 9A in a stand-up configuration. As described above with respect to FIG. 3, when the bag 300 is in a stand-up configuration, the first and second sidewalls 302 and 304 are separated from each other. As also shown in FIG. 10A, the interlocking closure structures 314A, 314B, 316A, and 316B are also separated from each other, such that an opening 312, which provides access to the interior of the bag 300, is formed along the top edge 324 of the bag 300. To separate the first and second sidewalls 302 and 304, the bottom portion 318 of the bag 300 is moved about shift regions (e.g., 122A, 122B, 123A, 123B, 124A, 124B, 124C, 124D, 125A, 125B, 125C, 126, and 128 of FIG. 3) such that the bottom portion 318 forms a substantially flat base for the upright bag 300. The bottom portion 318 of the bag 300 is thereby outlined by the shift regions (e.g., 124A, 124B, 124C, 124D, 126, and 128 of FIG. 3). As discussed above, shifting the bag 300 to the stand-up configuration is facilitated by grasping the bag 300 at certain portions of the bottom portion 318 of the bag 300 (e.g., 130A and 130B of FIG. 3), which, in effect, act as hinges that naturally effect shifting of the bag 300 to the stand-up configuration. The bag 300 of FIG. 10A, however, while being in the stand-up configuration, has not yet been cuffed by a user. In other words, the cuff region 320 of FIG. 10A is positioned underneath the interlocking closure structures 314A, 314B, 316A, and 316B, and the opening 312 of the bag 300 is still being formed along the top edge 324 of the bag 300.

Figure 10B:
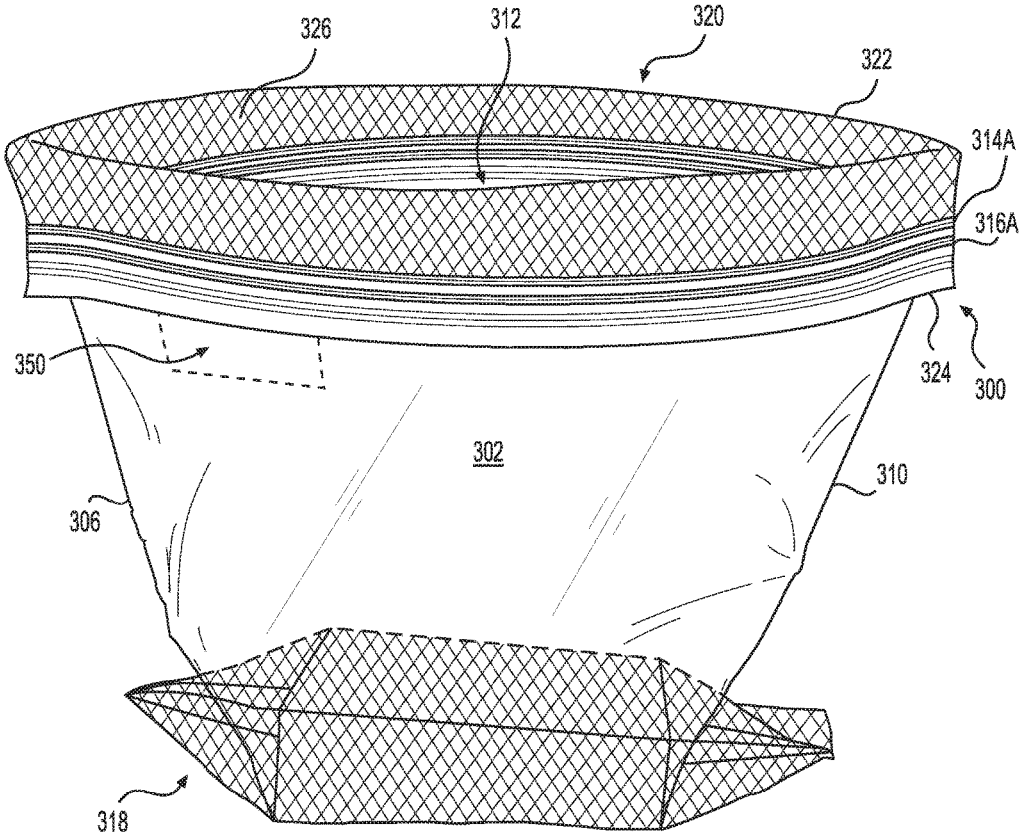
FIG. 10B is a perspective view of the bag shown in FIG. 10A with a top of the bag folded over.

FIG. 10B illustrates the bag 300 of FIG. 10A in both the stand-up configuration and after being cuffed by a user, in which the cuff region 320 is folded over the cuff line 322. In the cuffed position of FIG. 10B, the cuff region 320 of the bag 300, as well as the patterned band 326, are positioned at the top of the bag 300. As also shown in FIG. 10B, when the bag 300 is in the cuffed position, since the cuff region 320 has been folded over the cuff line 322, the cuff line 322 now forms a top, finished edge of the bag 300 that forms the opening 312 providing access into the interior of the bag 300. When the cuff region 320 has been folded over the cuff line 322, the interlocking closure structures 314A, 314B, 316A, and 316B are disposed along the exterior of the bag 300, such that contamination of the interlocking closure structures 314A, 314B, 316A, and 316B can be prevented while filling the bag. Moreover, cuffing the bag 300 by folding the cuff region 320 over the cuff line 322 creates a wider opening 312 that is easier to fill, as well as the ability to easily pour contents out of the bag 300.

Figure 11A:
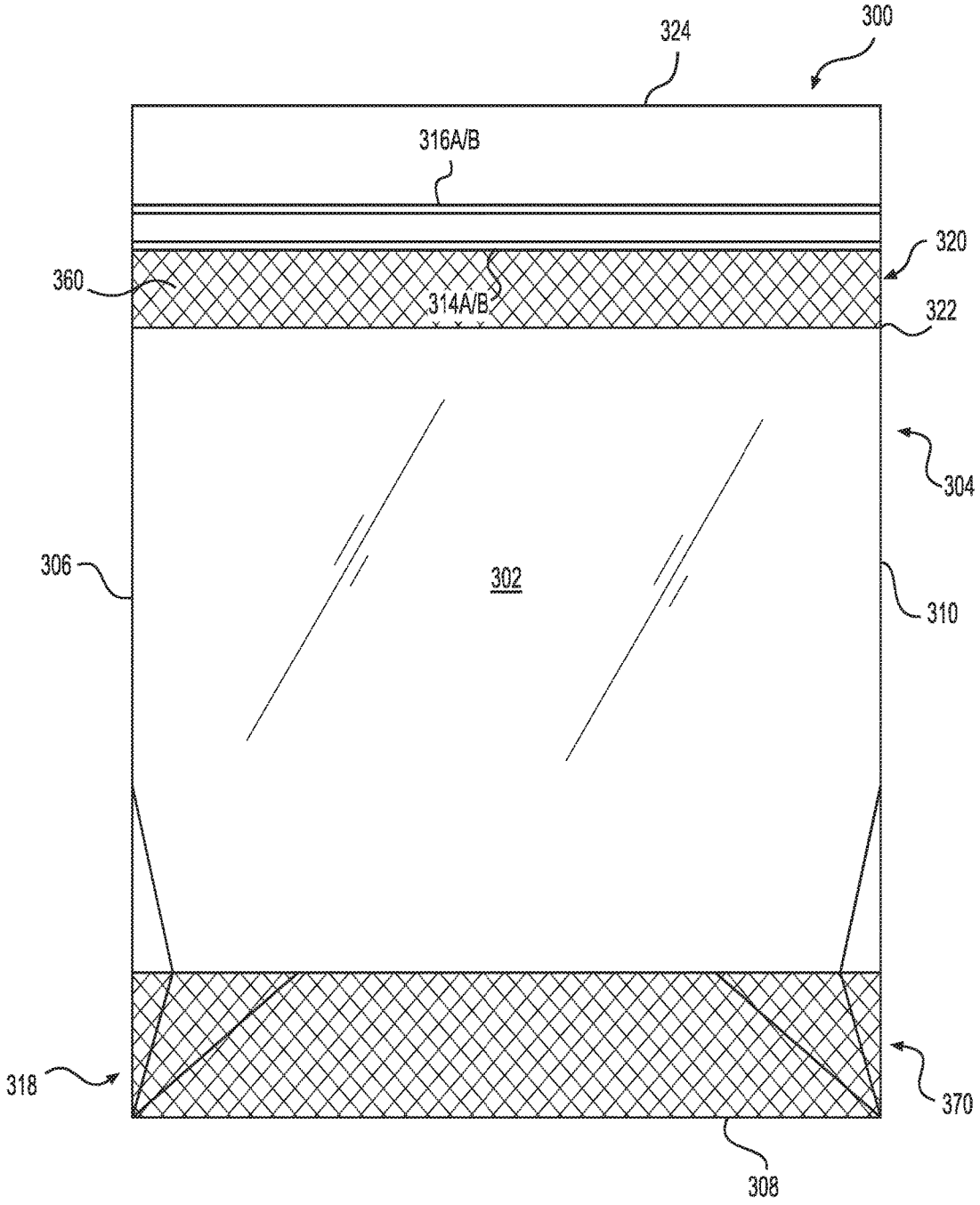
FIG. 11A is a side view of a bag according to another embodiment of our invention.
Figure 11B:
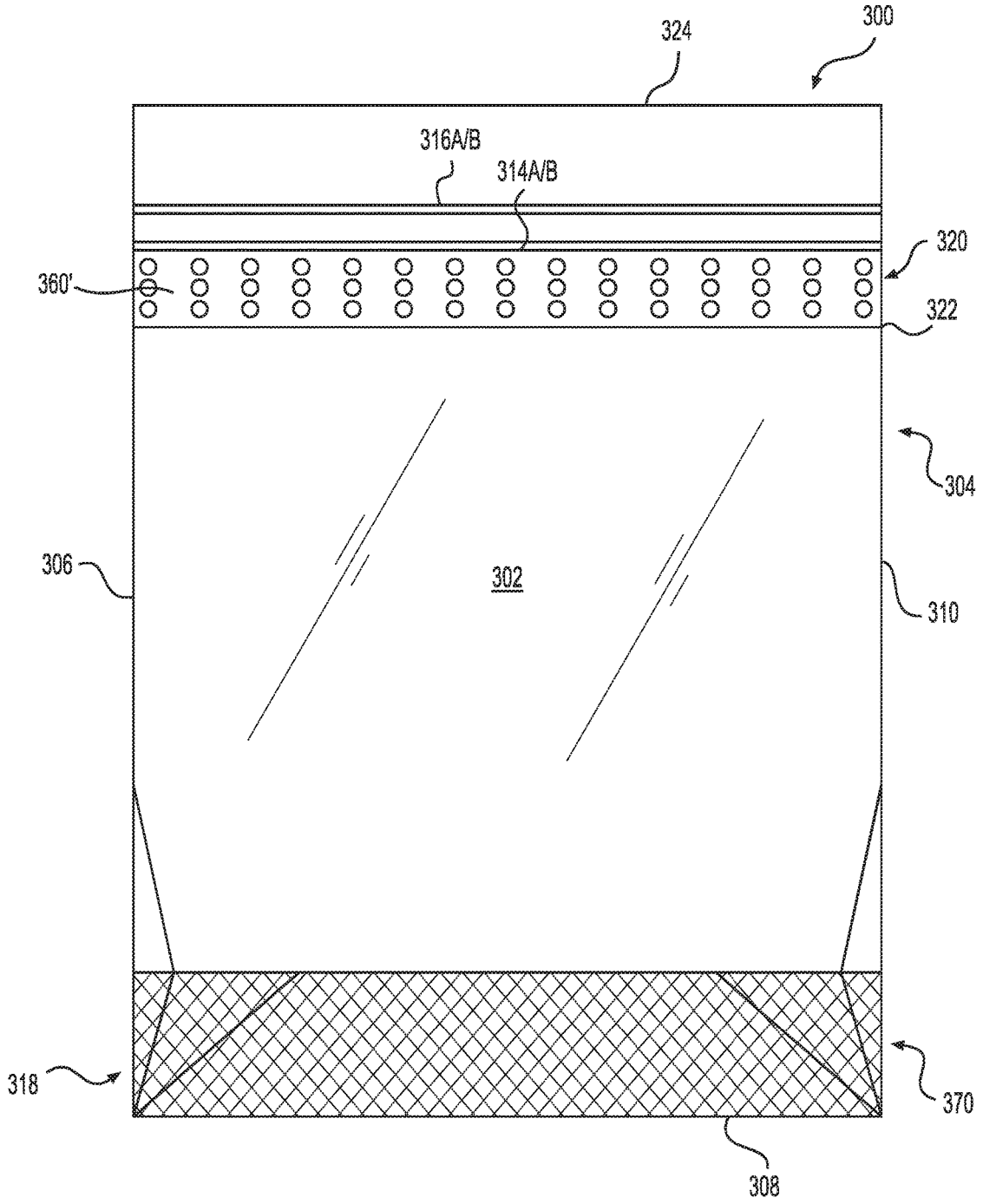
FIG. 11B is a side view of a bag according to yet another embodiment of our invention.

FIG. 11A illustrates one embodiment of the bag 300 in which a first patterned area 360 (e.g., patterned band 326) is provided between the interlocking closure structures 314A, 314B, 316A, and 316B and the cuff line 322, and a second patterned area 370 is provided in the bottom portions 318 of the first and second sidewalls 302 and 304. The patterned areas 360, 370 can be made to be visually distinct from the other portions of the first and second sidewalls 302 and 304, by, for example, printing techniques, embossing, extrusion, ultrasonic forming and blasting with sand or water jets, scratching the surface with a laser or other means, etc. In one embodiment, such as the one shown in FIG. 11A, the first patterned area 360 comprises a pattern that is the same or substantially the same as the pattern of the second patterned area 370. Alternatively, the first and second patterned areas 360, 370 may comprise patterns that are different (see, e.g., 360' and 370 of FIG. 11B).

As discussed above, a first patterned area 360 is provided between the interlocking closure structures 314A, 314B, 316A, and 316B and the cuff line 322 to (i) disguise the cuff line 322, (ii) add some stiffness to the cuff region 320, and/or (iii) provide a visual cue to a user as to where to fold down the cuff region 320 and cuff the bag 300 along the cuff line 322. As also discussed above with respect to the embodiment of FIG. 1A, a second patterned area 370 or texture can be formed in the bottom portions 318 of the first and second sidewalls 302 and 304, between horizontal shift regions of the first and second sidewalls 302 and 304. Such a patterned area 370 or texture may aid the user in identifying the bottom portions 318 that are to be shifted. Further, the patterned area 370 or texture may increase the friction of the base when the bag 300 is in the stand-up configuration, thereby further stabilizing the bag 300.

Figure 11C:
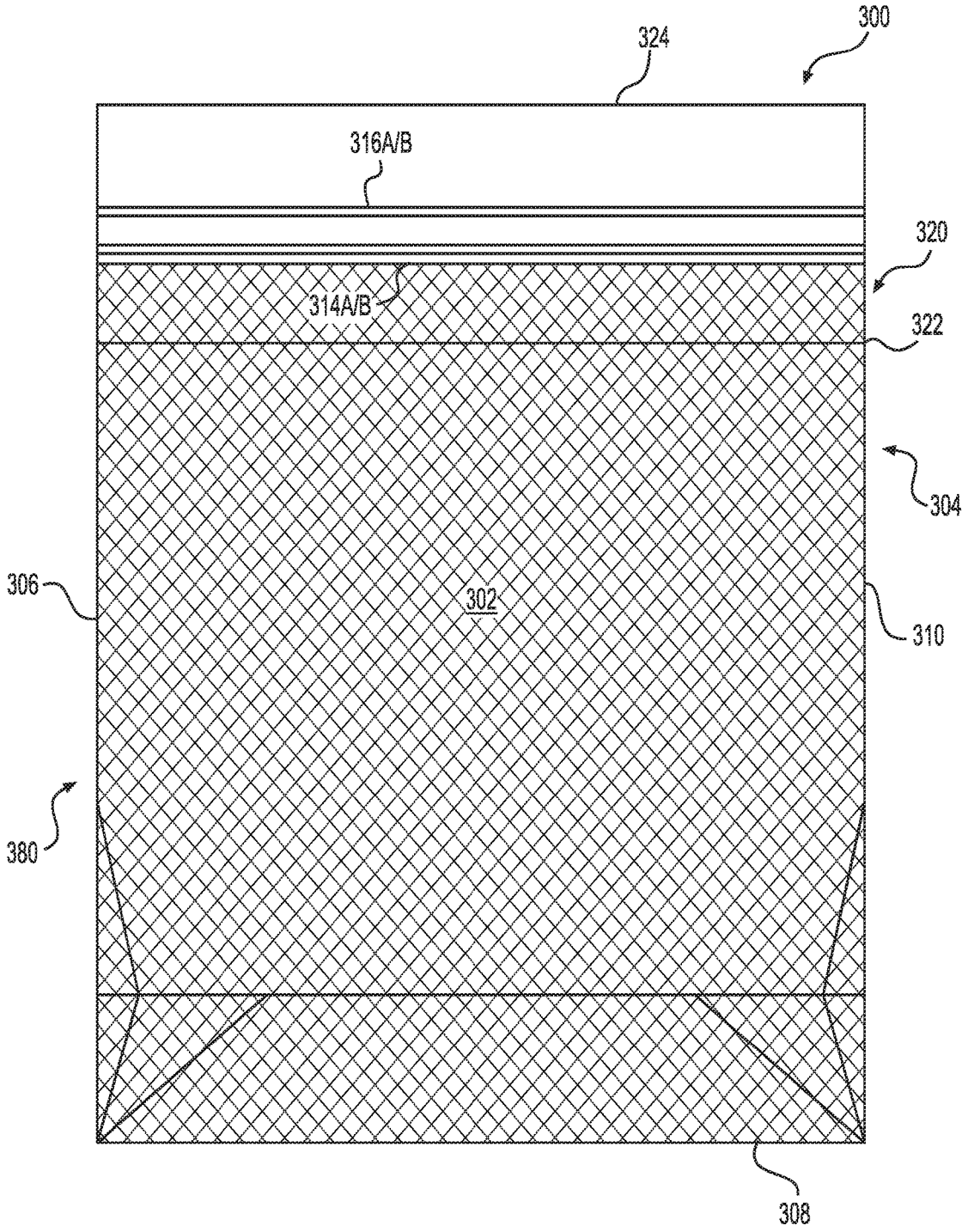
FIG. 11C is a side view of a bag according to another embodiment of our invention.

FIG. 11C illustrates an alternative embodiment of the bag 300 in which a patterned area 380 extends over a majority of the bag 300. In particular, in the embodiment of FIG. 11C, the patterned area 380 extends from below the interlocking closure structures 314A, 314B, 316A, and 316B to the bottom edge 308 of the bag 300, such that both the cuff line 320 and the shift regions of the bottom portions 318 are disguised. As discussed above, the patterned area 380 is made to be visually distinct from the other portions of the first and second sidewalls 302 and 304, by, for example, printing techniques, embossing, extrusion, ultrasonic forming and blasting with sand or water jets, scratching the surface with a laser or other means, etc.

With respect to the various patterned areas (e.g., 326, 360, 360', 370, 380) discussed above, a variety of patterns and/or textures may be used to create these areas. In addition, the patterned areas can comprise a variety of designs and/or shapes, including, for example, parallel lines, intersecting lines, intermittent lines, cross-hatching, curved lines, diagonal lines, diamond shapes, circular shapes, triangular shapes, X-shapes, S-shapes, clouds, flowers, stars, hearts, etc., and any combinations thereof. The patterned areas (e.g., 326, 360, 360', 370, 380) may further comprise raised portions created, for example, by way of ultrasonic embossing or embossing with a die press. Moreover, the patterned areas (e.g., 326, 360, 360', 370, 380) may have the same or substantially the same thickness as the sidewalls 302 and 304 of the bag 300. In other embodiments, the patterned areas (e.g., 326, 360, 360', 370, 380) of the bag 300 are made to be thicker in order to further facilitate the stand-up configuration, as well as the cuffing of the bag 300 (as shown, for example, in FIG. 10B).

A bag according to our invention is highly functional inasmuch as it can be made to stand upright without being held by a user. The bag can thereby be set on a surface, and easily filled by the user. This stand-up configuration is achieved without the use of a pleat, gusset, or other additional structure at the bottom portion of the bag. Thus, the bag can be made to lay substantially flat when not in use, and thereby be compactly stored. Further, by not including an additional structure at the bottom portion, the bag can be made from substantially less material than other stand-up bags known in the art. Those skilled in the art will recognize numerous other advantageous of our bag based on the foregoing description.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

The invention described herein can be used in the commercial production of storage bags. Such storage bags have a wide variety of uses, such as being utilized to store food, chemicals, or other substances.

We claim:

1. A storage bag comprising:

(A) a first sidewall having a top edge, a top portion, and a bottom portion, and including at least one shift region about which the bag is capable of shifting, the at least one shift region being provided in the bottom portion of the first sidewall, and the at least one shift region comprising one of (a) a score line, (b) an indentation, and (c) a crimp formed into the first sidewall;

(B) a second sidewall connected to the first sidewall along three sides of the bag to form an interior of the bag with an opening thereto, the second sidewall having a top edge, a top portion, and a bottom portion; and (C) a cuff region disposed below the top edge of the first sidewall and the top edge of the second sidewall, the cuff region being provided in the top portion of each of the first and second sidewalls, and the cuff region comprising a textured patterned band to provide a visual cue to a user as to where to fold and to cuff the bag, wherein the bag shifts:

(a) between (i) a flat configuration with the first and second sidewalls positioned adjacent to each other, and (ii) a stand-up configuration with the first and second sidewalls separated from each other, such that, in the stand-up configuration, the bag has a substantially flat base, and (b) about the cuff region such that the bag can be shifted to a cuffed position with the cuff region forming the opening to the bag.

2. A storage bag according to claim 1, the first sidewall further comprising a cuff line provided in the top portion of the first sidewall, the cuff line comprising at least one shift region about which the bag is capable of shifting.

3. A storage bag according to claim 2, wherein the at least one shift region of the cuff line of the first sidewall comprises one of (i) a score line, (ii) an indentation, and (iii) a crimp formed into the first sidewall.

4. A storage bag according to claim 2, the second sidewall further comprising a cuff line provided in the top portion of the second sidewall, the cuff line comprising at least one shift region about which the bag is capable of shifting.

5. A storage bag according to claim 4, wherein the at least one shift region of the cuff line of the second sidewall comprises one of (i) a score line, (ii) an indentation, and (iii) a crimp formed into the second sidewall.

6. A storage bag according to claim 4, wherein the cuff line of each of the first and second sidewalls comprises a straight line that extends from a first edge to a second edge of the respective sidewall.

7. A storage bag according to claim 4, wherein the cuff line of each of the first and second sidewalls comprises a dashed line that extends from a first edge to a second edge of the respective sidewall.

8. A storage bag according to claim 4, wherein the cuff line of each of the first and second sidewalls comprises a curved line that extends from a first edge to a second edge of the respective sidewall.

9. A storage bag according to claim 1, wherein the first sidewall further includes a first interlocking closure structure and the second sidewall further includes a second interlocking closure structure, the first interlocking closure structure being configured to interlock with the second interlocking closure structure to seal the opening of the bag.

10. A storage bag according to claim 9, wherein, on the first sidewall, the cuff region is disposed below the first interlocking closure structure, and wherein, on the second sidewall, the cuff region is disposed below the second interlocking closure structure.

11. A storage bag according to claim 9, wherein the first sidewall further includes a third interlocking closure structure disposed below the first interlocking closure structure, and the second sidewall further includes a fourth interlocking closure structure disposed below the second interlocking closure structure, the third interlocking closure structure being configured to interlock with the fourth interlocking closure structure to seal the opening of the bag.

12. A storage bag according to claim 11, wherein, on the first sidewall, the cuff region is disposed below the third interlocking closure structure of the first sidewall, and wherein, on the second sidewall, the cuff region is disposed below the fourth interlocking closure structure of the second sidewall.

13. A storage bag according to claim 1, wherein the textured patterned band is formed by embossing.

14. A storage bag according to claim 1, wherein the bottom portion of at least one of the first sidewall and the second sidewall comprises a patterned area.

15. A storage bag according to claim 14, wherein at least one of the textured patterned band and the patterned area is formed by embossing.

16. A storage bag according to claim 14, wherein the textured patterned band comprises a pattern that is the same as the pattern of the patterned area.

17. A storage bag according to claim 14, wherein the textured patterned band comprises a pattern that is different from the pattern of the patterned area.

18. A storage bag according to claim 1, wherein each of the first sidewall and the second sidewall comprises a patterned area that extends from a point below the cuff region to at least the bottom portion of each of the first and second sidewalls, and wherein the patterned area of each of the first and second sidewalls is included for at least one of (i) disguising the at least one shift region of the first sidewall, (ii) adding stiffness to each of the first and second sidewalls, and (iii) providing a visual cue to a user as to where to fold and to cuff the bag.

19. A storage bag according to claim 18, wherein the patterned area is formed by embossing.

20. A storage bag according to claim 1, wherein the at least one shift region of the first sidewall includes (i) shift regions that extend from near a first corner of the first sidewall and (ii) shift regions that extend from near a second corner of the first sidewall, and wherein, in the stand-up configuration, the bag is shifted about each of the shift regions of the first sidewall such that the substantially flat base is formed for the bag.

21. A storage bag according to claim 1, wherein the at least one shift region of the first sidewall includes (i) a first shift region that extends from near a first corner of the first sidewall, (ii) a second shift region that extends from near the first corner of the first sidewall, (iii) a third shift region that extends from near a second corner of the first sidewall, and (iv) a fourth shift region that extends from near the second corner of the first sidewall, and wherein, in the stand-up configuration, the bag is shifted about the first, second, third, and fourth shift regions of the first sidewall in order to form the substantially flat base for the bag.

22. A storage bag according to claim 1, wherein the second sidewall further includes at least one shift region about which the bag is capable of shifting, the at least one shift region being provided in the bottom portion of the second sidewall, and the at least one shift region comprising one of (i) a score line, (ii) an indentation, and (iii) a crimp formed into the second sidewall.

23. A storage bag according to claim 22, wherein the at least one shift region of the second sidewall includes (i) shift regions that extend from near a first corner of the second sidewall and (ii) shift regions that extend from near a second corner of the second sidewall, and wherein, in the stand-up configuration, the bag is shifted about each of the shift regions of the second sidewall such that the substantially flat base is formed for the bag.

24. A storage bag according to claim 22, wherein the at least one shift region of the second sidewall includes (i) a first shift region that extends from near a first corner of the second sidewall, (ii) a second shift region that extends from near the first corner of the second sidewall, (iii) a third shift region that extends from near a second corner of the second sidewall, and (iv) a fourth shift region that extends from near the second corner of the second sidewall, and wherein, in the stand-up configuration, the bag is shifted about the first, second, third, and fourth shift regions of the second sidewall in order to form the substantially flat base for the bag.

* * * * *